US006302165B1

(12) United States Patent
Nanaji et al.

(10) Patent No.: US 6,302,165 B1
(45) **Date of Patent: *Oct. 16, 2001**

(54) SITE FUELING VAPOR RECOVERY EMISSION MANAGEMENT SYSTEM

(75) Inventors: Seifollah S. Nanaji, Greensboro; Hal C. Hartsell, Jr., Kernersville, both of NC (US)

(73) Assignee: Marconi Commerce Systems Inc., Greensboro, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/512,542

(22) Filed: Feb. 24, 2000

Related U.S. Application Data

(63) Continuation-in-part of application No. 09/150,392, filed on Sep. 9, 1998.

(51) Int. Cl.[7] ..... B65B 1/04

(52) U.S. Cl. ..... 141/59; 141/83

(58) Field of Search ..... 141/59, 94, 290, 141/392, 83, 192, 198; 73/23.2; 340/632

(56) References Cited

U.S. PATENT DOCUMENTS 5,507,325 * 4/1996 Finlayson .
5,605,182 * 2/1997 Oberrecht et al. .

* cited by examiner

*Primary Examiner*—Steven O. Douglas
(74) *Attorney, Agent, or Firm*—Withrow & Terranova PLLC

(57) ABSTRACT

A service station vapor management system including a plurality of vapor handling subsystems and a controller in electronic communication with the vapor handling subsystems for monitoring subsystem operation, determining an overall service station V/L ratio and controlling subsystem operation to maintain the V/L ratio or total site hydrocarbon emissions within predetermined limits.

31 Claims, 15 Drawing Sheets

SITE FUELING VAPOR RECOVERY EMISSION MANAGEMENT SYSTEM

This application is a continuation-in-part of application Ser. No. 09/150,392, filed Sep. 9, 1998, pending.

BACKGROUND OF THE INVENTION

The present invention relates to vapor handling systems in a fueling environment, and more particularly, to a centralized vapor recovery site management controller configured to receive information from various devices in the fueling environment and make logical decisions based on the received information to maximize the vapor recovery efficiency of the site.

Distributed, assist vapor recovery systems, such as Gilbarco, Inc.'s Vapor Vac® system are used to recover hydrocarbon vapors that normally escape to the atmosphere from vehicle tanks during refueling and return these vapors to the underground storage tank. Most of these assist vapor recovery systems have a vapor recovery rate that is a function of the fuel delivery rate of the dispenser.

These vapor recovery systems are tested and certified by the California Air Resources Board (CARB) and other regulatory agencies. This testing requires each system to be tested for vapor recovery efficiency during refueling popular make and model cars. For example, the current CARB test requires that each vapor recovery system be tested on 100 popular model cars. The amount of vapor recovered and vapor lost during the testing is used to determine efficiency.

Because of variations in vehicle fuel neck designs, the recovery efficiency of the fuel neck will vary considerably. The objective in obtaining CARB certification is to tune the assist systems recovery algorithm to achieve 95% efficiency when measured over the vehicles and the certification test. Another major variable that will have a dramatic effect on overall site efficiency is equipping vehicles with onboard vapor recovery systems (ORVR). ORVR equipment vehicles were introduced with the 1988 model year and will be phased into almost all vehicles over the next nine years. When fueling an ORVR equipped vehicle, most vapors will be retained in the vehicle, and the assist vapor recovery system, if unmodified, will pump air into the fuel storage tank. The net effect will be to increase storage tank pressure causing so-called "fugitive" emissions. A number of systems have been developed to deal with these emissions.

With the implementation of digital electronic control into vapor recovery system designs, it is possible to establish the best vapor recovery vapor/liquid (V/L) ratio or curve for each model vehicle tank and filler neck design, among other variables, and store them in memory in the vapor recovery system. It is also possible to add a smart card or transponder-type device to the vehicle to communicate with the dispenser and provide the dispenser with information necessary to select an appropriate vapor recovery algorithm for the vehicle. For further information regarding specific control of vapor recovery based on ORVR detection, see U.S. Pat. No. 5,782,275 the content of which is hereby incorporated herein by reference.

Each of the systems described above operates independently of each other without accounting for its effect on the other. Up to this point no central control device has been provided to coordinate the separate efforts of these systems so as to monitor and/or maintain a particular site's V/L ratio. Additionally, there has been no effort to monitor and control the total vapor emissions level for a particular site. The present invention addresses these and also other problems that may not be specifically detailed herein.

SUMMARY OF THE INVENTION

The present invention relates to a service station vapor management system that advantageously manages vapor handling subsystems to achieve a particular performance characteristic for an entire site. The present invention coordinates the operation of these subsystems to control V/L ratio and hydrocarbon vapor emissions from a location perspective. Previous vapor recovery control systems have addressed the control of a particular item of equipment such as an individual dispenser.

The present invention provides these advantages by providing a service station vapor management system that includes a plurality of vapor handling subsystems and a controller in electronic communication with the vapor handling subsystems for monitoring subsystem operation, determining an overall service station V/L ratio and controlling subsystem operation to maintain the V/L ratio within predetermined limits. The system may also include at least one ambient temperature sensor or at least one atmospheric pressure sensor for providing ambient temperature or atmospheric pressure information to the controller. This control system is in electronic communication with the controller.

The invention also relates to a service station vapor management system including at least one fuel dispenser vapor recovery system for collecting vapor generated during a vehicle fueling operation and returning the vapor to an underground tank and a controller in electronic communication with the dispenser vapor recovery system for monitoring the operation of the system, and controlling the operation of the at least one vapor recovery system to prevent the discharge of more than predetermined amount of hydrocarbon vapors from the service station In an alternative embodiment, the system may also relate to a service station vapor management system including a plurality of sensors for measuring service station vapor recovery subsystem operating parameters and generating signals indicative of the parameters and a controller for receiving the sensor signals, determining an overall service station V/L ratio and controlling the operation of vapor recovery subsystem components to maintain the service station V/L ration within acceptable limits. The sensors may measure parameters such as individual fuel dispenser V/L ratio, hydrocarbon content of vapor being returned to underground storage tanks by fuel dispenser vapor recovery systems, ORVR vehicle status of vehicles being fueled at a fuel dispenser, service station ambient temperature, and service station ambient atmospheric pressure. Additionally, the sensors may also measure underground tank ullage conditions.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

DESCRIPTION OF THE PREFERRED EMBODIMENTS

Figure 1A:
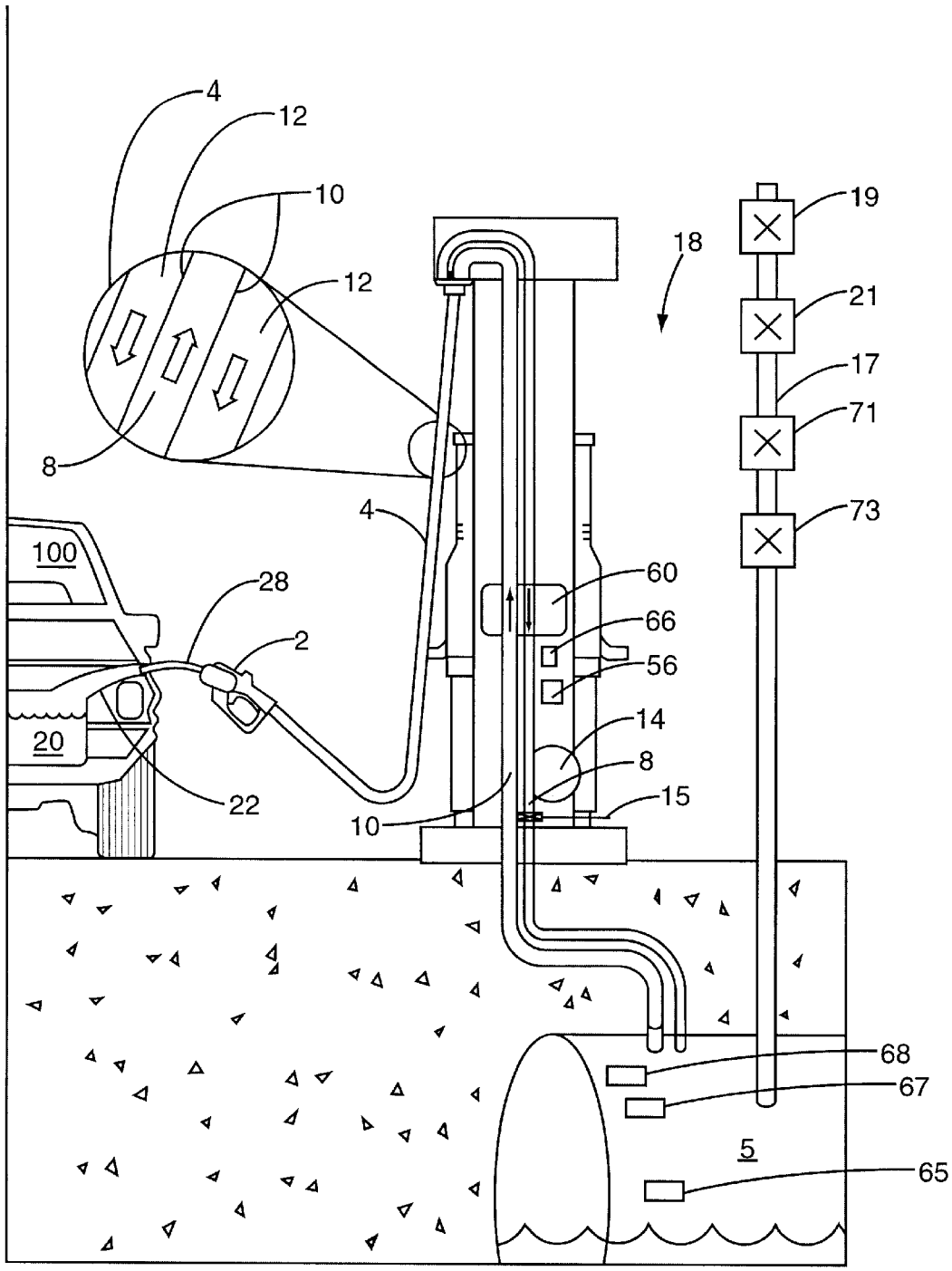
FIG. 1A is an elevational and partial sectional view of a typical gasoline dispenser having a vapor recovery system.

Referring now to the drawings in general, it will be understood that the illustrations are for the purpose of describing a preferred embodiment of the invention and are not intended to limit the invention thereto. Given the complexity of the present invention, a basic overview of a typical fueling environment is described to provide a proper foundation for describing the present invention.

As best seen in FIG. 1A, an automobile 100 is shown being fueled from a gasoline dispenser or pump 18. A spout 28 of nozzle 2 is shown inserted into a filler pipe 22 of a fuel tank 20 during the refueling of the automobile 100. A fuel delivery hose 4 having vapor recovery capability is connected at one end to the nozzle 2, and at its other end to the fuel dispenser 18. As shown by the cutaway view of the interior of the fuel delivery hose 4, an annular fuel delivery passageway 12 is formed within the fuel delivery hose 4 for distributing gasoline pumped from an underground storage tank (UST) 5 to the nozzle 2.

Also within the coaxial fuel delivery hose 4 is a tubular vapor recovery passageway 8 for transferring fuel vapors expelled from the vehicle's fuel tank 20 to the underground fuel storage tank (UST) 5 during the fueling of a vehicle that is not equipped with an onboard vapor recovery system. The fuel delivery hose 4 is depicted as having an internal vapor recovery hose 10 for creating the vapor recovery passage 8. The fuel delivery passageway 12 is formed between the hose 10 and hose 4.

A vapor recovery pump 14 provides a vacuum in the vapor recovery passage 8 for removing fuel vapor during a refueling operation. The vapor recovery pump 14 may be placed anywhere along the vapor recovery passage 8 between the nozzle 2 and the underground fuel storage tank 5.

UST 5 includes a vent 17 and a pressure-vacuum vent valve 19 for venting the UST 5 to atmosphere. The vent 17 and vent valve 19 allow the UST 5 to breathe to equalize substantially the ambient and tank pressures as well as control hydrocarbon vapor levels to minimize breathing losses. Preferably, the vent valve 19 is controllable. That is, the vent valve 19 can be opened and closed in response to remote commands. Alternatively, the vent valve 19 may be constructed to open and close at preset pressure and vacuum points. Typical set points include +3 inches of water pressure and −8 inches of water.

The vapor recovery system using the pump 14 may be any suitable system such as those shown in U.S. Pat. Nos. 5,040,577 to Pope, 5,195,564 to Spalding, 5,333,655 to Bergamini et al., or 3,016,928 to Brandt, the disclosures of which are incorporated herein by reference. Various ones of these systems are now in commercial use, recovering vapor during refueling of conventional, non-ORVR vehicles. The present invention addresses an adaptation of those systems for managing overall VR operation for the entire fueling environment.

Figure 1B:
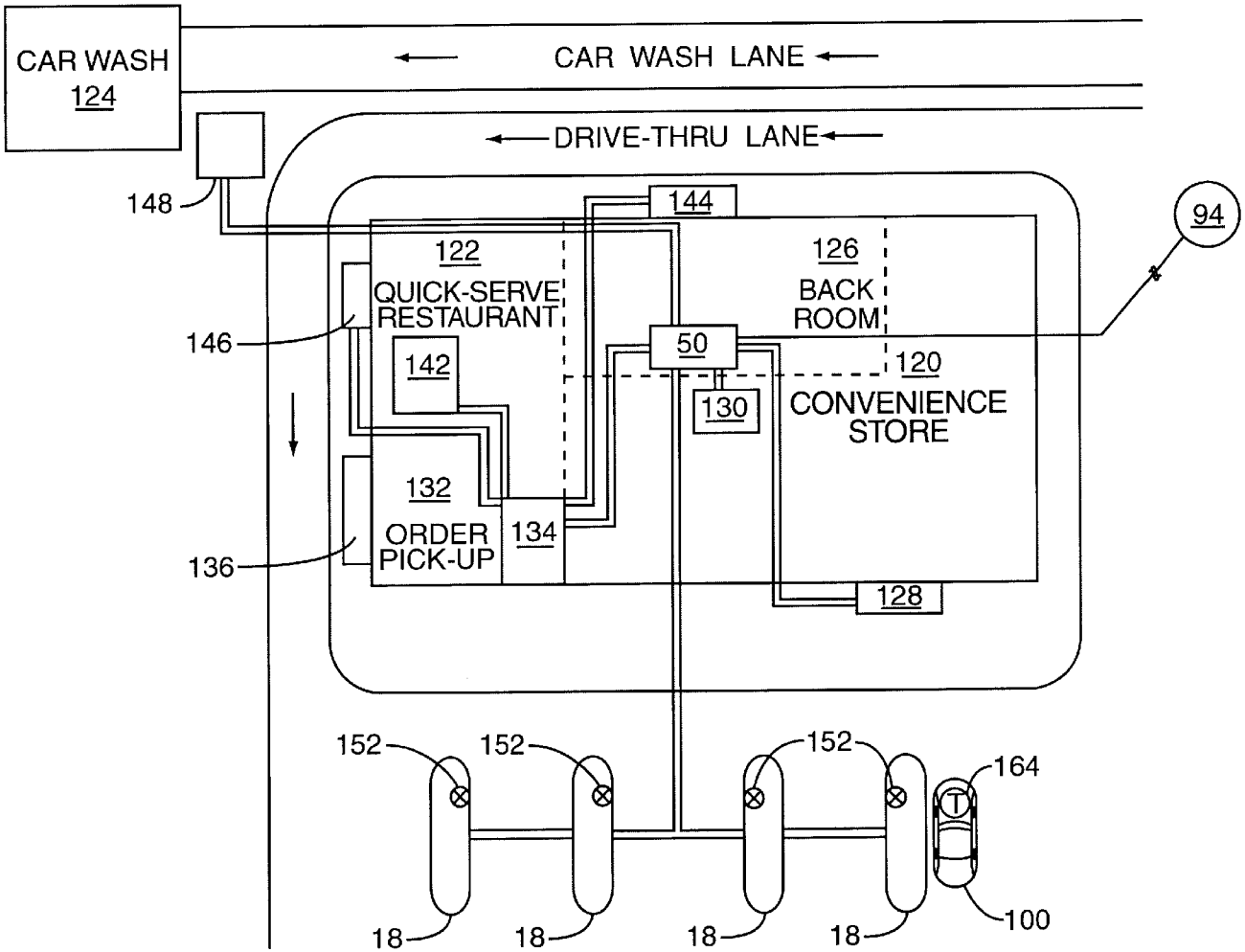
FIG. 1B is a block diagram providing a basic overview of a modern fueling environment.

FIG. 1B depicts a typical fueling and retail environment including a forecourt where the fuel dispensers 18 are located, a convenience or fuel station store 120, one or more quick-serve restaurants (QSR) 122, a car wash 124, and a backroom 126. The backroom 126 is generally the central control area for integrating or coordinating control of the fuel dispensers 18, convenience store 120, QSR 122, and car wash 124. In the present invention, it is preferable to incorporate any necessary control for the overall vapor recovery site management system in this central control area. This central control area will include a central control system 50 configured with the necessary hardware, software.

The central control system 50 may include a number of individual controllers for various parts of the fueling environment to provide overall system control integration. The central control system 50 will typically interface with the dispensers 18, store transaction terminal 130, quick-serve restaurant terminals for in store pickup 134, drive-through ordering 144, drive-through pickup 132 and food preparation 142. The control system 50 may also interact with a car wash 124 and its associated controller 148 in addition to outside vending machines 128. Additionally, the fueling environment, and preferably, the dispensers 18, will have communication electronics, such as interrogators 152, providing communications between transponders 164. In the present invention, the transponders 164 maybe configured to transmit information indicative of the presence of ORVR equipment, and optionally, information aiding the dispenser's vapor recovery system and optimizing vapor recovery. Such information may include the type of ORVR equipment, automobile fuel tank configuration, fuel tank internal ullage pressure, volume or vapor pressure or preferred vapor recovery functions for the particular make or model of the vehicle.

Figure 2A:
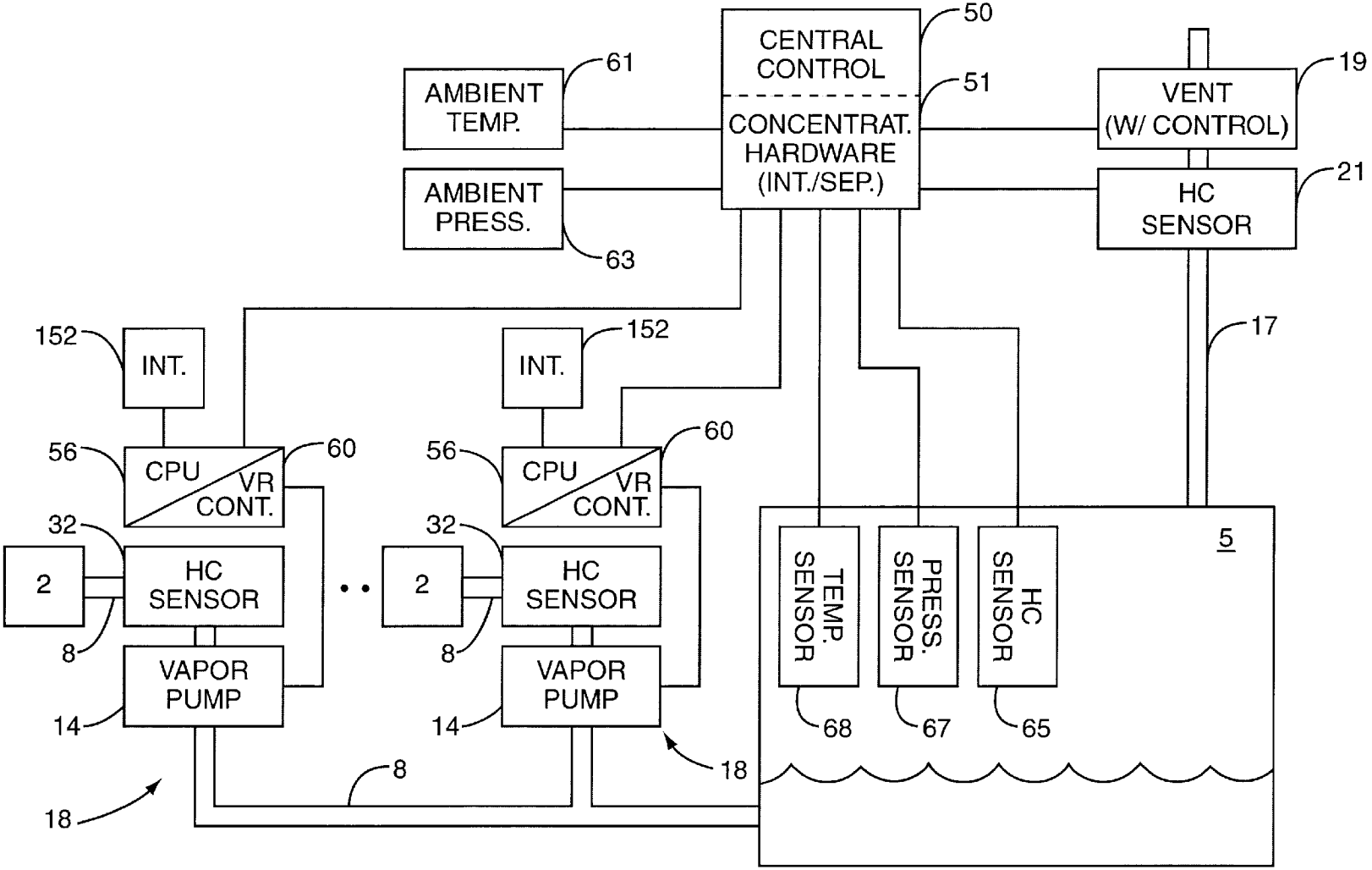
FIG. 2A is a schematic diagram of a first embodiment of a vapor recovery site efficiency management system constructed according to the present invention.
Figure 2B:
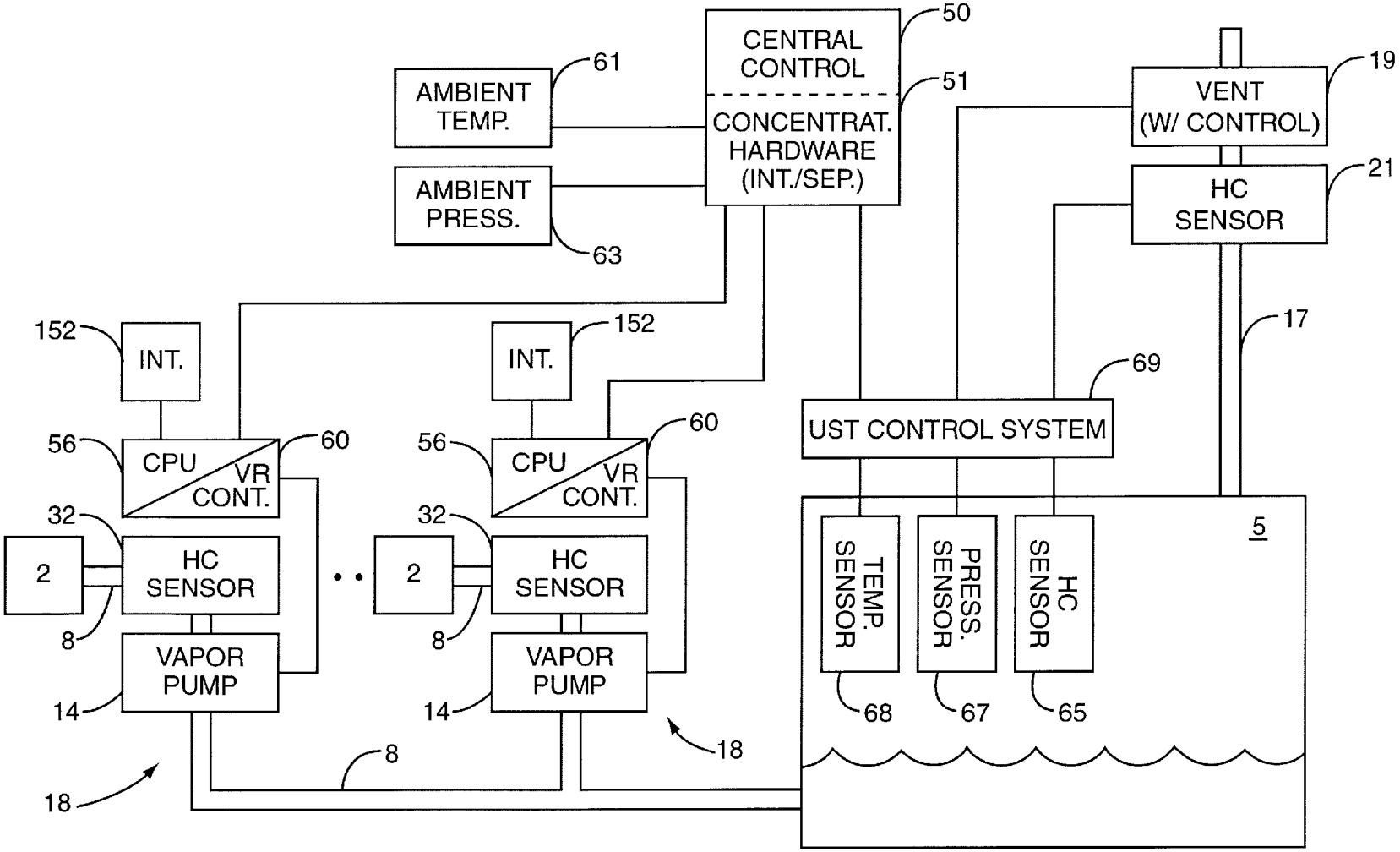
FIG. 2B is a schematic diagram of a second embodiment of a vapor recovery site efficiency management system constructed according to the present invention.

With reference now to FIGS. 2A and 2B, a schematic of the basic configurations of the preferred embodiments are shown. At the heart of the invention is the central control system 50, which as noted above, may be the central controller for the entire station or the dedicated vapor recovery management control system located anywhere in the fueling environment. Depending on the number of components and systems interfacing with the controller, concentrating hardware may be preferable to manage the input and output control corresponding to the various peripheral systems and components. The concentrating hardware 51 may be substantially integrated with the control system 50 or completely separate therefrom.

The central control system 50 may interface with one or more of the following systems or components: fuel dispensers 18, the underground storage tank 5, and ambient measurement devices.

Most notably, the fuel dispensers 18 will include the CPU 56 and any necessary hardware or software for vapor recovery control of a vapor recovery pump 14. The dispensers 18 will include the vapor recovery passage 8 and preferably a hydrocarbon sensor 32 associated with the vapor recovery passage 8 and/or an interrogator 152 configured to communicate with ORVR equipped vehicles. Generally, each fuel dispenser 18 controls its own vapor recovery system under the direction of the CPU 56 and vapor recovery controller 60. The manner in which vapor recovery is controlled is based on the presence of ORVR equipment, V/L ratios and/or information from the central control system 50 relating to overall management of vapor recovery for the site. Information concerning the presence of an ORVR equipped vehicle maybe received through RFID techniques using the interrogator 152, directly or indirectly sensing hydrocarbon concentrations in the vapor recovery passage, sensing pressure changes in the vapor recovery passage, or any other known or future method for detecting ORVR equipment The vapor recovery rates may be based on information received from the vehicle through the interrogator 152, control algorithms for general vapor recovery, specific vapor recovery control algorithms for a type of vehicle, fuel delivery rate, fuel tank initial volume at the beginning of the fueling process and/or temperatures and pressures relating to the vapor recovery system or the ambient. There are many variables bearing on vapor recovery control. Prior to Applicants' invention, these variables were individual dispenser related. That is to say, a vapor recovery control process was carried out in individual fuel dispensers without reference to the service station's overall V/L ratio, the number of ORVR vehicles fueled during a given time span or the total amount of hydrocarbon vapors emitted from the site. Each dispenser vapor recovery system operated independently without accounting for the effects of its operation on these site parameters. Thus, while individual dispensers 18 may have been operating in what was assumed to be a proper manner, the site as a whole may have been a net positive emitter of hydrocarbon vapors beyond limits established by environmental regulators.

The present invention treats the individual dispenser control systems as subsystems and provides an additional variable from the central control system 50. This variable takes into consideration one or more aspects of the vapor recovery environment outside any individual dispenser 18 and provides the ability to adapt the individual dispenser's vapor recovery control subsystem as necessary to optimize site efficiency.

To optimize site efficiency, the central control system 50 is provided access to ambient temperature data through an ambient temperature sensor 61 and ambient atmospheric pressure data through an ambient pressure transducer 63. Furthermore, the central control system 50 has access to hydrocarbon concentration, pressure and temperature information relating to the underground storage tank 5 and its vent 17. In particular, hydrocarbon sensors 21, 65 maybe placed in the vent 17 for the underground storage tank 5, respectively. The underground storage tank 5 may also include a temperature sensor 68 and a pressure sensor 67. Preferably, the vent 17 is provided with a controllable vent valve 19 in order to variably control venting. The vent valve 19 will preferably derive a portion of its control from the central control system 50, either directly or indirectly through other control systems associated with the underground storage tank 5.

As shown in FIG. 2B, vent control and sensor inputs may be directed to an underground storage tank control subsystem 69 which is in communication with the central control system 50. In such an embodiment, the central control system 50 will basically interact with the dispenser control systems and the underground storage tank control subsystem 69 in order to optimize site efficiency. The UST control system may be an ullage pressure control system as disclosed in U.S. Pat. Nos. 5,464,466, 5,755,854, and 5,626,649 to Nanaji, 5,803,136 to Hartsell, and pending application Ser. No. 08/490,442, filed May 12, 1995 and 08/915,389 filed Aug. 20, 1997, the disclosures of which are hereby incorporated herein by reference. Another UST pressure control system is disclosed in U.S. Pat. No. 5,484,000 to Hasselmann, the content of which is hereby incorporated by reference. Notably, these disclosures provide additional detail on the particular operation of various underground storage tank control systems without the influence of the central control system 50 providing overall site management.

The central control system 50 will also directly or indirectly receive information from the underground storage tank 5 relating to tank pressure, temperature, hydrocarbon concentrations and any other variables decided to influence vapor recovery efficiencies for the entire site and control UST 5 and vent 17 operation to prevent undue emissions of hydrocarbons into the atmosphere. In addition to the internal tank conditions, conditions in the tank vent 17 including hydrocarbon concentrations may be provided to the central control system 50. As depicted in the drawing figures, the central control system 50 may be directly linked to these various sensors or configured to receive information from the underground storage tank 5 control system 69. Control signals or information directed to the underground storage tank may likewise be sent directly to any system, such as the vent control valve 19, directly or through the underground storage tank control system 69. Although not depicted, ambient temperature and pressure may be read by the underground storage tank control system 69 or any one of the numerous dispensers in the forecourt. Furthermore, all of the signals to the various vapor handling systems within the dispensers 18, underground storage tank 5, or sensors may be provided to the central control system 50 or through concentrating hardware 51 used to manage peripheral interface with the central control system 50. Those skilled in the art will recognize the various configurations available to provide the central control system 50 with the necessary information to manage and control site efficiencies.

During operation, information may be received from three sources: 1) the fuel dispenser 18, 2) the underground storage tank 5, and 3) sensors or systems providing data on ambient conditions. Additional sources of information include the dispenser vapor recovery subsystem, the tank ullage control subsystem and a vehicle discrimination subsystem. Notably, the dispenser 18 or underground storage tank 5 may be configured to provide information bearing on ambient conditions to include, but not limited to, ambient temperature at the site and ambient atmospheric pressure. The practice of the present invention includes tying other vapor handling subsystems to the central controller as needed and desired.

Typically, the dispenser 18 may provide information relating to vapor recovery performance and conditions for the individual dispenser, the presence or type of ORVR equipment on a vehicle being fueled or vehicles having been fueled, and, as noted above, ambient conditions. The vapor recovery information may include V/L ratios, operating efficiencies, and equipment conditions. The ORVR equipment information may be received using a radio frequency identification device (RFID) technique wherein information is directly communicated from the vehicle 100 to the dispenser 18 indicating the presence or absence of ORVR equipment, and optionally, providing vehicle configuration information or vapor recovery control functions to help optimize vapor recovery with respect to that particular vehicle. Alternatively, the dispenser 18 may detect the presence of ORVR equipment on a vehicle 100 based on techniques including sensing hydrocarbon concentrations or pressure increases in the vapor return passage 8 that are indicative of the presence of ORVR equipment Any other techniques for detecting or determining the presence of ORVR equipment on the vehicle 100 is acceptable.

Information from the underground storage tank 5 and vent 17 may include tank ullage pressure, tank ullage temperature, and tank ullage/tank vent hydrocarbon concentration. These and other variables may be monitored depending on the sophistication of the underground storage tank system and whether or not it includes a separate ullage pressure control or vapor handling system such as those disclosed in the U.S. patents and patent applications referred to above.

The dispensers 18 and underground storage tank 5 control systems may be configured to collect historical information relating to any of the above parameters. Alternatively, the central control system 50 may periodically gather information and maintain historical records as desired to gather information helpful in monitoring and controlling site efficiencies. Notably, the UST vent 17 may share control processes with the underground storage tank control system 69 or may include its own control system for monitoring hydrocarbon concentrations, the ingress or egress of air and/or hydrocarbon vapors to and from the underground storage tank 5, and controlling venting. In such an embodiment, the processor would preferably communicate directly with the central control system 50 or concentrating hardware 51.

Figure 2C:
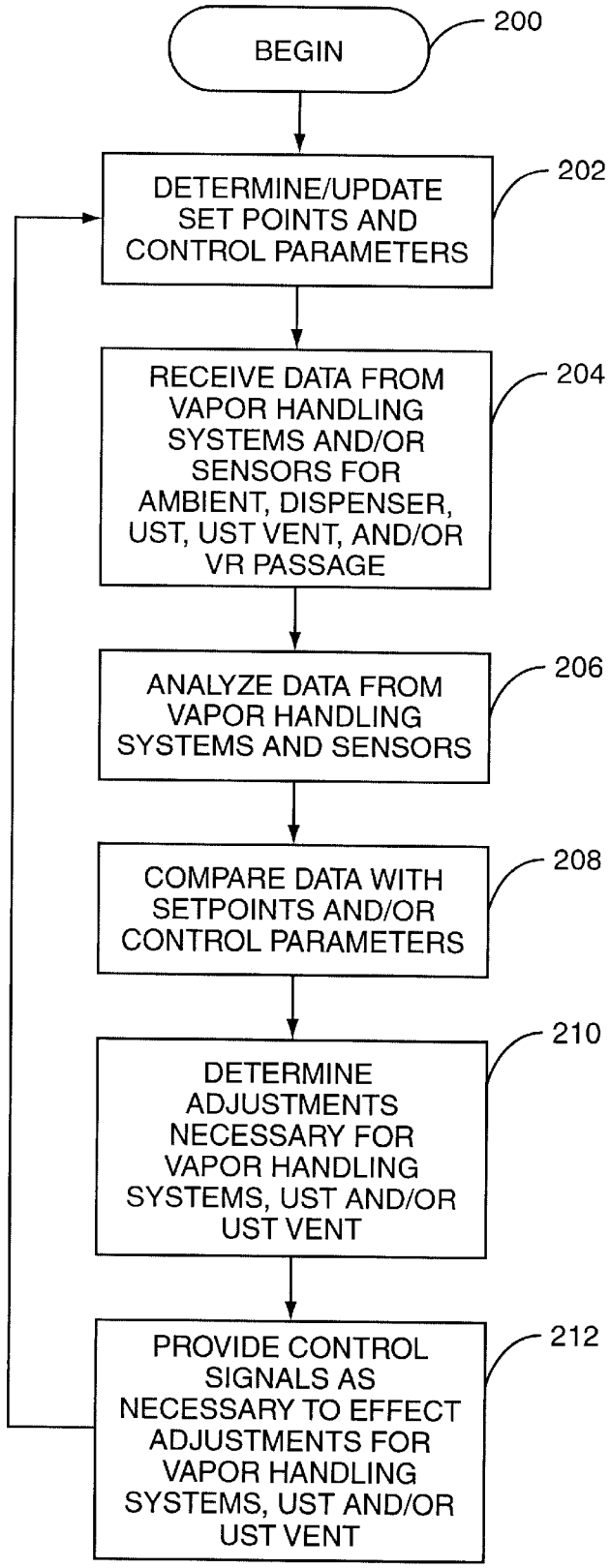
FIG. 2C is a flow diagram of the overall site management control system.

With reference to FIG. 2C, basic operation of the overall site management control system is shown. The process starts at block 200 where various set points and control parameters are checked, determined or updated as desired (block 202). Next, the information necessary for the particular management configuration is received from the various vapor handling systems and/or sensors providing selected information from that described immediately above (block 204). The information is analyzed (block 206) and compared as with the set points and/or control parameters (block 208). The control system will then determine any necessary adjustments for the vapor handling subsystems, underground storage tank 5 and/or underground storage tank vent 17 to maintain or move toward a desired overall operational state (block 210). If any adjustments are necessary, the central control system 50 will provide the necessary control signals to affect adjustments to the vapor handling subsystems in the dispensers 18, and/or the underground storage tank 5, and/or the underground storage tank vent 17 (block 212).

In a preferred embodiment, the central control system 50 treats the site as a whole by taking input from the several vapor handling subsystems and sensors to make logical decisions regarding the values of variable subsystem parameters to maximize the vapor recovery efficiency of the site. The term "vapor handling subsystems" includes individual fuel dispenser vapor recovery systems, vehicle discrimination systems to include vehicle interrogation systems and UST ullage pressure control systems and any other systems that transport, manage or are otherwise associated with hydrocarbon vapors generated during fueling operations. To affect these changes that improve efficiency, this system provides input to the Stage II assist vapor recovery subsystems in the fuel dispensers 18 to adjust their V/L ratios to improve efficiency in recovering vapors. The system may also make changes to the fuel storage tanks venting system to control the amount of ingress or ambient air or the amount of egress of an air/hydrocarbon vapor mixture. To acquire the necessary data for decision making and implementation of these functions, any one or more of the following is preferably used: pressure transducers, hydrocarbon sensors, mass spectrometers 73, vapor flow meters 71, intelligent assist vapor recovery system controls, temperature sensors, and electronically controlled and operated storage tank vent valving.

In a typical operating scenario, the central control system 50 receives underground fuel storage tank and ambient air temperatures and uses this information to adjust a baseline V/L value in the dispenser's vapor recovery system. The primary objective of the present invention is to increase efficiency in the transfer of vapor from the fill neck 22 of the vehicle. In all cases, the V/L ratio must be greater than or equal to that required to achieve an acceptable transfer recovery efficiency at the fill neck 22. As the ambient temperature and the temperature within the underground storage tank may fluctuate and change the relative pressure of the vapor within the underground storage tank 5, the dispenser's vapor recovery systems may need to fluctuate as well to provide the proper vacuum to achieve the desired transfer efficiency. Likewise, if the pressure within the underground storage tank 5 is already high, such that fugitive emissions may occur, the V/L of a particular transaction may be modified such that fugitive emissions are less likely to occur. This array of sensors allows the central control system 50 to judge effectively when it is appropriate to increase the vapor recovery rate or decrease the vapor recovery rate such that the average site V/L remains acceptable to the appropriate regulating agency. Independent of, or in conjunction with, this action, the central control system 50 may keep a record of a number of ORVR and non-ORVR vehicle refueling operations and corresponding storage tank ullage pressures. From this data, the controller calculates the average site VAL, and determines changes in dispenser V/L values, either individually or by site, and may also define the amount of ingress or egress to allow at the storage tank vent.

The control system 50 used in the practice of the present invention may desirably use one or more trained artificial neural networks (ANN) or fuzzy logic devices to affect the control of the various vapor handling subsystems. An ANN is a well-known tool for handling problems that involve many variables. A typical ANN is a computer program, modeled roughly after the human brain that can learn to perform tasks and make decisions based on past experiences or examples. Computers so programmed "learn" by gathering and storing information from the computer user. When the computer receives new information, it uses its stored expertise to classify or recognize a new pattern in the information. As applied to the fueling environment, the ANN may be trained to expect certain patterns of environmental conditions, i.e. temperature swing from day to night and variances in vehicle traffic that effect the amount of hydrocarbon vapor generated at a site. The latter of these two could encompass data concerning the average number of ORVR-equipped vehicles that can be expected to be fueled at a particular site. Having knowledge of this past site information, the ANN may control the various vapor handling subsystems to maintain a particular overall site V/L ratio, to control total site hydrocarbon vapor emissions, or to control fugitive emissions from a UST 5. It will be readily appreciated that an ANN trained for a cold weather climate site may manage vapor handling subsystems much differently than that for a hot weather climate site. The use of an ANN as just described is not intended to limit the scope of the present invention. It will be readily apparent to one of ordinary skill that other pattern type information may be used to control other aspects of the service station operation.

The scope of the invention is only limited by the ability of those expert in the art and science of hydrocarbon vapor recovery to identify, quantify and control the site variables that contribute to efficient control of hydrocarbon emissions. As in most commercially viable products, cost effectiveness ultimately determines the actual system configuration. Other physical parameters considered by the ANN may include seasonal changes in the fuel, stored fuel temperature, ambient air temperature, tank pressure as a function of ullage, the rate of refueling as a function of time, time of day, and so on. The system can use this information to make periodic or continuous corrections to the operation of the dispenser's vapor recovery system, the tank venting parameters or any number of site variables affecting vapor recovery efficiency and containment of hydrocarbons.

Preferably, this system will track the fueling of ORVR and non-ORVR equipped vehicles and use this information to adjust each dispenser's vapor recovery system V/L ratio or curve for non-ORVR vehicles. When fueling an ORVR vehicle, the central site controller 50 can send commands to the individual dispenser to turn the vapor recovery system off or modify the V/L ratio. The system can increase V/L for non-ORVR vehicles if the underground storage tank pressure stays low most of the time. It can also decrease the V/L to the minimum certified level for non-ORVR vehicle refueling if the underground storage tank pressure increases during a period of the day or night. This process will minimize the pressure differential between the underground storage tanks 5 and atmosphere. If the underground storage tank 5 experiences excessive pressure at night, which results in emission of vapor through the vent stack, the system may gradually decrease the V/L for non-ORVR vehicles to the minimum certified level during the hours prior to station close or the time when tank pressure starts to go up. This process prevents or minimizes fugitive emissions.

Although in most instances the amount of vapors recovered from the nozzle-fuel tank interface will be reduced when an ORVR vehicle is detected, in certain instances the V/L ratio will not be changed. It has been found that ORVR systems using mechanical seals rather than liquid seals do not present the kinds of excess air ingestion problems described herein. Consequently, there would be no need to modify fuel dispenser vapor recovery system performance. Accordingly, the practice of the present invention includes the additional step of determining what type of seal mechanism is installed in the fill neck of an ORVR vehicle and using that information to make the decision whether or not to modify dispenser vapor recovery system operation. Under certain circumstances, no changes would be made to that operation.

In conjunction with the central site control system 50, or independently thereof, each dispenser 18 may be configured to adjust and correct the V/L ratio after a predetermined number of ORVR vehicles have been refueled. A preprogrammed family of algorithms or the ability to compute internally the algorithm necessary to make the appropriate adjustment may be provided. Furthermore, a central control system can monitor individual dispenser 18 usage and adjust its respective V/L ratio to achieve the minimum necessary level of vapor recovery at the vehicle fill-neck 22 in order to reduce storage tank pressure. The system can also adjust the V/L ratios in those dispensers 18 that are used less by the customers to further manage underground storage tank pressure. In the above-cases, each dispenser 18 may end up having its own V/L ratio at any given time. A history of adjustments can be recorded and be available for inspection.

In this regard, the history of system adjustments and performance can be made available to an offsite location in a variety of ways. By way of non-limiting example, the central control system 50 may print periodic reports concerning the vapor emission performance of a particular location. Alternatively, remote electronic access may be provided using dial up connections, satellite communications links or internet links. Each of these communication methods could provide historical information on a periodic batch basis or, alternatively, provide the ability to monitor system performance in a "real time" fashion. It will be readily appreciated that a remote central monitoring station could be established for monitoring the operation of a number of sites. Data from these sites can be assembled and analyzed to provide an area-wide assessment of vapor emission performance. The benefits of this approach include, but are not limited to, the ability to identify sites that require equipment maintenance, to monitor the population distribution of ORVR and non-ORVR vehicles, and to identify those locations/areas that are not in compliance with emissions limits. This data could be made available to regulatory authorities to meet compliance inspection requirements again using the electronic communications links discussed above.

The provision of remote monitoring of site vapor emission performance makes remote adjustment of system performance possible. That is, responsive to the system performance data received at a remote location, a person or a controller remote from the location may transmit instructions to the onsite controller 50 to change system performance. This approach is an extension of the concept of coordinating the operation of the vapor handling subsystems at a particular location. The practice of the present invention includes coordinating the operation of a number of individual vapor emitting locations as part of a cohesive strategy for addressing vapor emissions for a particular geographic area.

The system can also automatically record tank pressure or fugitive emission violations with the times and dates of such occurrences. Violations can be reported to maintenance personnel and allow the entire site to, in effect, provide a self compliance method of operation. Historical information concerning these violations can be used by regulators for enforcement efforts.

In addition to controlling vapor recovery and the flow of hydrocarbons to the vents 17 of the underground storage tanks 5, a solenoid valve on the tank vent 17 makes it possible for the system to check for leaks in the underground piping and the tank installation. The system may monitor tank pressure while the solenoid valve is closed and there is no refueling activity at the site. Pressure changes may be monitored over time. If the pressure change during this time is greater than a predetermined value, the central site control system 50 can send a request to maintenance personnel or the station manager to check for possible leakage or other system malfunctions. This feature can also by used as part of a self-compliance program. Furthermore, the system may have a leak detection program that closes the vent valve 19, increases the tank pressure to a predetermined level, stops all fueling activities for a predetermined period of time and checks for a pressure drop. As noted, the tank vent 17 may be equipped with a vapor flow meter 71 that measures the amount of egress and ingress from and into the underground storage tank. The vapor flow meter 71 maybe directly coupled to the central control system 50 or the concentrating hardware 51. Alternatively, the flow meter 71 may be coupled directly to an underground storage tank control system, as disclosed in FIG. 2B. Vent 17 may also be equipped with a thermocouple, or a hydrocarbon sensor configured as a mass spectrometer 73 to measure the concentration and/or the amount of harmful volatile organic compounds in the egress vapor from the UST 5 and the amount of ambient air ingressed to the UST 5. The output of the vapor flow meter 71 can be recorded for emission calculations.

It is also possible to install a secondary vapor processor on the vent stack to eliminate hydrocarbon emissions in case of any egress from the UST 5. The processor can be equipped with a thermocouple, vapor flow meter 71, hydrocarbon sensor and/or mass spectrometer 73 to monitor its efficiency and output into the atmosphere. In all of the cases above, the output of all measurement and monitoring devices is directly or indirectly fed to the central site controller 50. This controller 50 is used to make the decisions on setting, affecting, and/or controlling vapor recovery and vapor recovery ratios throughout the system.

Figure 3:
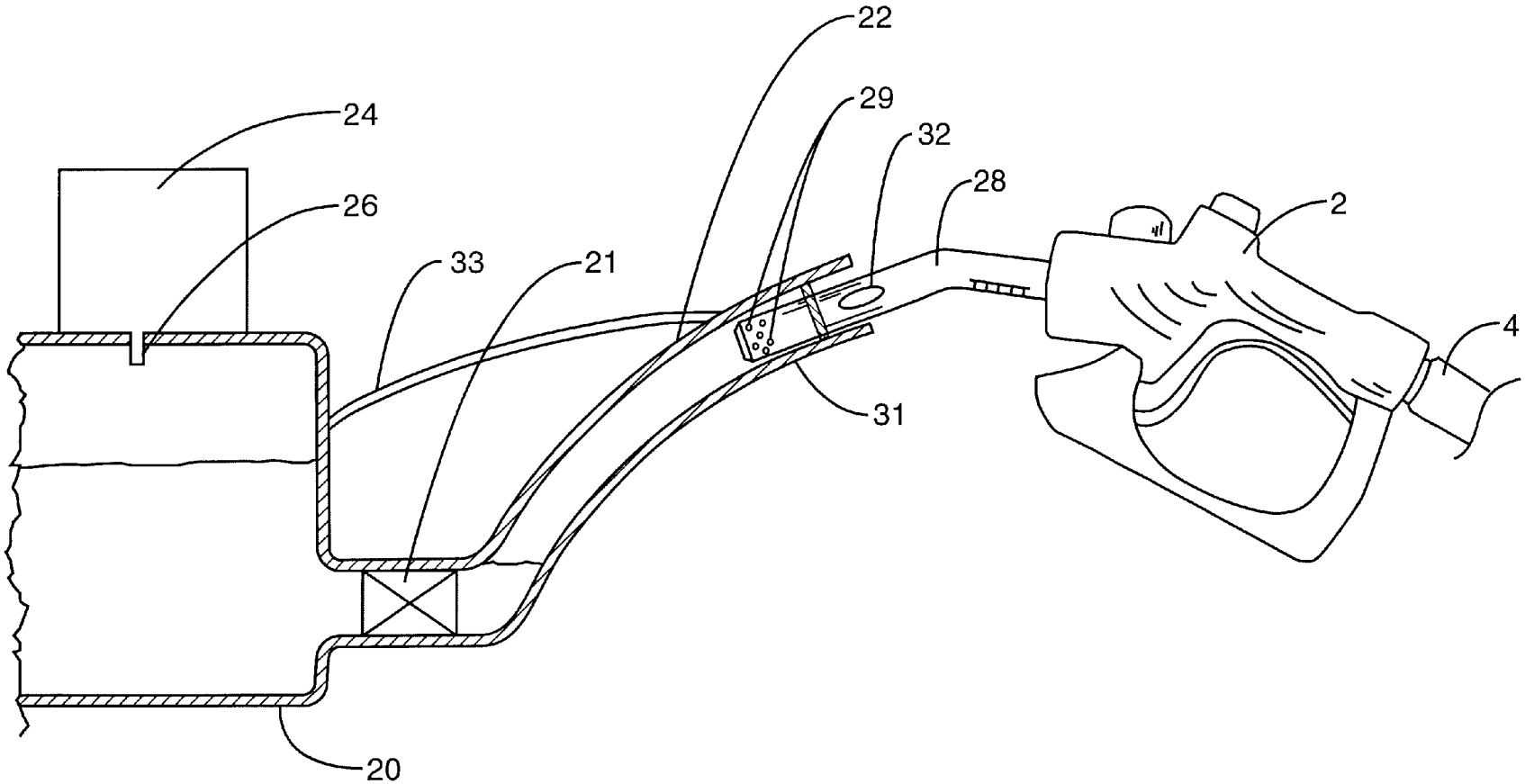
FIG. 3 depicts a typical vacuum assist vapor recovery nozzle and the cross section of a fuel tank of a vehicle equipped with onboard recovery vapor recovery equipment.

Turning now to FIG. 3, the vehicle fuel tank 20 of an ORVR vehicle has an associated onboard vapor recovery system 24. These onboard vapor recovery systems 24 typically have a vapor recovery inlet 26 extending into the tank 20 (as shown) or the fill neck 22 and communicating with the vapor recovery system 24. In the ORVR system of FIG. 3, incoming fuel provides a seal in fill neck 22 to prevent vapors from within the tank 20 to escape. This sealing action is often referred to as a liquid seal. As the tank fills, pressure within tank 20 increases and forces vapors into the vapor recovery system 24 through the vapor recovery inlet 26. Other ORVR systems may use a check valve 21 along the fill neck 22 to prevent further loss of vapors. The check valve 21 is normally closed and opens when a set amount of gasoline accumulates over the check valve within the fill neck 22.

The spout 28 has numerous apertures 29. The apertures 29 provide an inlet for fuel vapors to enter the vapor recovery path 8 of fuel dispenser 18 from the vehicle's fill neck 22. As liquid fuel rushes into the fuel tank 20 during a fueling of a vehicle not equipped with an ORVR system, fuel vapors are forced out of the fuel tank 20 through the fill neck 22. The fuel dispenser's vapor recovery system pulls fuel vapor through the vapor recovery apertures 29, along the vapor recovery path 8 and ultimately into the UST 5 (as shown in FIG. 1).

Figure 4:
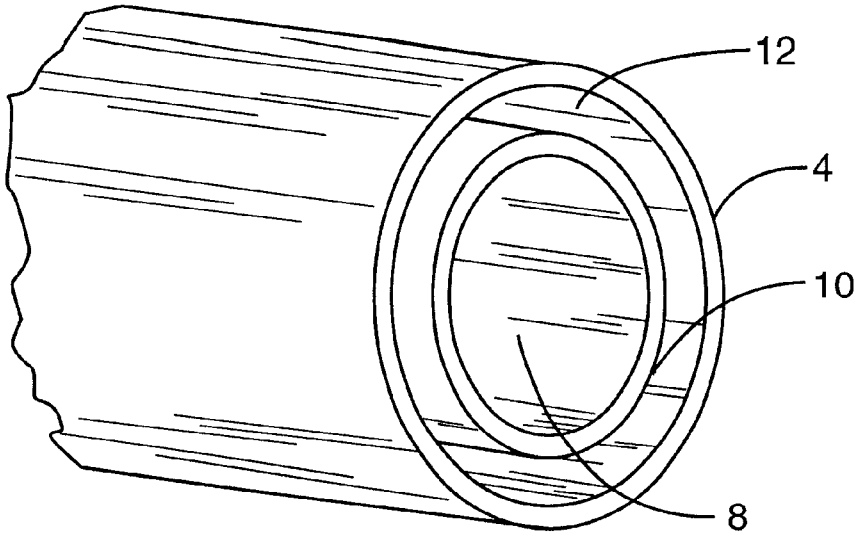
FIG. 4 is a perspective view of a fuel dispenser hose configured for use with a gasoline dispenser having a vapor recovery system.
Figure 5:
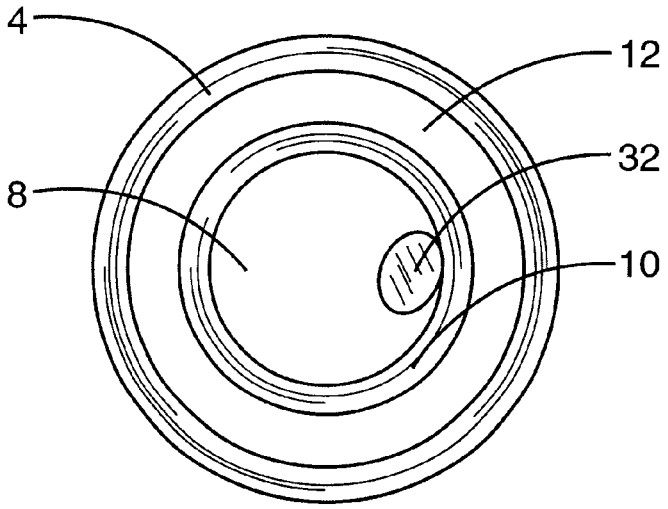
FIG. 5 is a cross-sectional view of a gasoline dispenser hose having a sensor in the vapor return path.

FIGS. 4 and 5 depict partial and complete cross-sectional views of the fuel dispenser hose 4. In an embodiment of the current invention, a hydrocarbon sensor 32 is placed inside the vapor passage 8 to detect the presence or absence of hydrocarbons associated with fuel vapors. An absence of hydrocarbons in the vapor passage 8 indicates the presence of an onboard vapor recovery system in the vehicle being fueled. If an onboard system is detected, the dispenser could either shut off the vapor pump 14 completely, or calculate and control the pump 14 to supply the amount of air to UST 5 needed to replenish the volume of liquid taken from UST 5 and thus eliminate breathing losses. The hydrocarbon sensor 32 may be located anywhere along the vapor recovery passage 8, including within the vapor recovery pump 14, storage tank 5, dispenser 18, or hanging hardware. Certain applications will locate the hydrocarbon sensor 32 at either, or both, an inlet or outlet to the vapor recovery pump 14.

Figure 6:
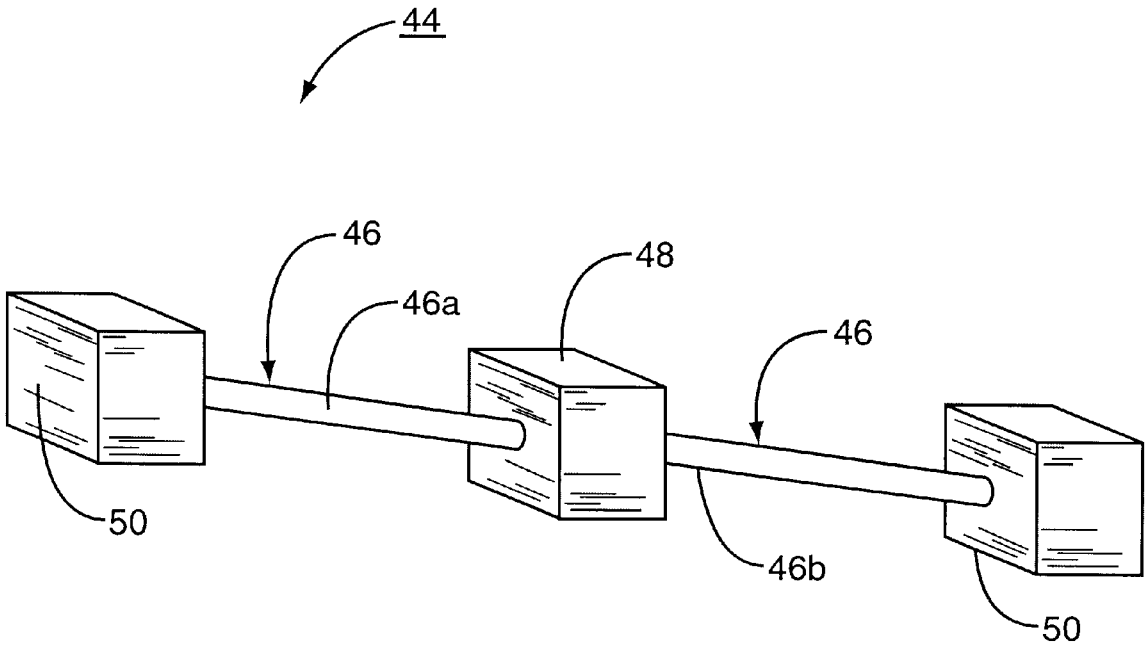
FIG. 6 is an enlarged perspective view of a fiber-optic hydrocarbon sensor.

In one embodiment, the hydrocarbon sensor 32 is a fiber-optic sensor 44 capable of sensing an amount or concentration of hydrocarbons present in the vapor return passage 8 to detect the presence of an ORVR-equipped vehicle. The fiber-optic sensor 44 is shown in detail in FIG. 6. Preferably, the fiber-optic sensor 44 uses two fiber-optic light rails 46, a sense fiber 46*a* and a reference fiber 46*b*. The sense fiber 46*a* has a special coating and the reference fiber 46*b* is isolated. The light rails 46*a* and 46*b* run between a single light source 48 and two photodetectors 50. The photodetectors 50 may be photodiodes. The refractive index of the sense fiber 46*a* changes when in contact with hydrocarbon vapor, causing the fiber to lose light through its surface. This loss of light is proportional to the concentration of hydrocarbon vapor. The amount of light transmitted by the reference fiber 46*b* is compared to the amount transmitted by the sense fiber 46*a*. Since they share the same light source 48, any change in the output voltages at the photodetectors 50 can be attributed to the losses from the side of fiber 46*a* caused by the concentration of the vapor stream.

Figure 7:
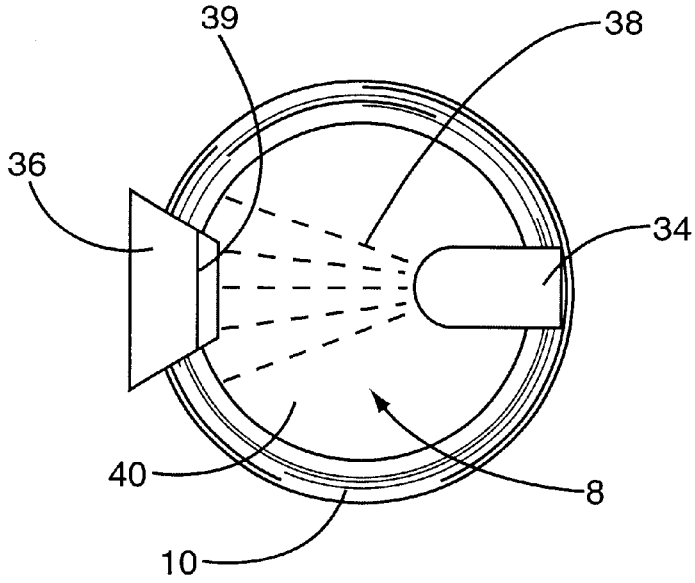
FIG. 7 is a cross-sectional view of a vapor return passage having an infrared transmitter and receiver.

As seen in FIG. 7, another embodiment employs an infrared emitter 34 and an infrared detector 36 as a hydrocarbon sensor in the tubing 10. Preferably, the infrared emitter 34 is either a solid state or a black body radiator with an appropriate filter, if required, irradiating through a cross-section of sampled vapor 40 to the infrared detector 36. An optical bandpass filter 39 may be used to narrow the sensor sensitivity to certain wavelengths. The infrared detector 36 is either solid state or pyro-electric infrared (PIR).

The attenuation in the infrared spectrum 38 caused by the absorption of infrared by hydrocarbons is detected by detector 36. When the amount of hydrocarbons to absorb the infrared falls from an expected level during operation, the fuel dispenser 18 may disable or adjust its vapor recovery system.

Desirably, there is a response time of less than 6 seconds from the beginning of the fueling operation or within delivering one gallon of fuel before detecting whether fuel vapors are normal, present in abnormally low quantities, or not present. The absence or low concentration of hydrocarbons indicates that the vehicle is equipped with an onboard vapor recovery system. The hydrocarbon sensors, the same as or similar to those described above, may be used in the underground storage tank 5 and associated vent system.

The discussion of sensing to this point has focused on determining amount or concentration of hydrocarbon material in vapor form being returned to the UST 5 by the dispenser vapor recovery system. An alternative approach would be to sense the oxygen concentration of the returning vapor stream. It will be readily appreciated that a stream rich in hydrocarbon vapors will be have a low oxygen content and that a stream low in hydrocarbon vapor content will have a higher oxygen content. Thus, monitoring the oxygen content of the vapor stream can provide the same feedback concerning the ORVR status of a vehicle being fueled as that provided by monitoring the hydrocarbon vapor content. The practice of the present invention includes using both approaches.

Figure 8:
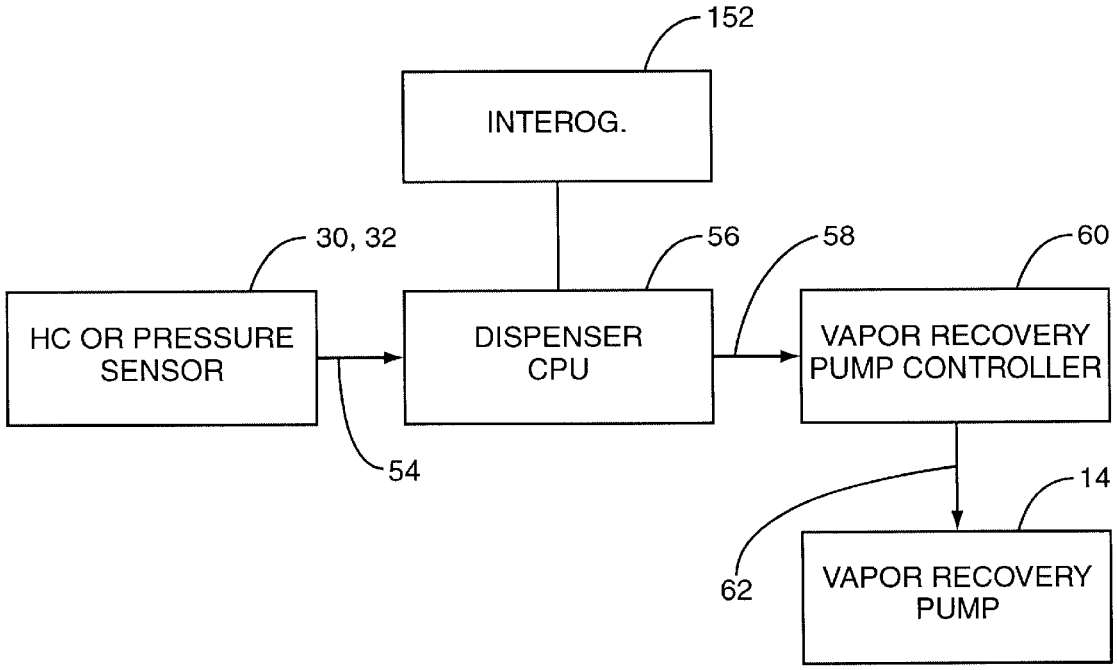
FIG. 8 is a schematic block diagram of a portion of the gasoline dispenser's vapor recovery control system.

The dispenser electronics, as depicted in block diagram in FIG. 8, process a resulting signal 54 from the sensor, whether it be of fiber-optic sensor 44, IR detector 36 or some other sensor, and take appropriate action. The action could take any of several forms. The vapor return pump 14 could slow down to reduce the effective vacuum, thereby reducing the effect of vapor growth which the ingestion of clean air often creates. Breathing losses are a major cause of fugitive emissions. If the UST pressure is greater than the ambient pressure, hydrocarbon saturated fuel vapor is released into the atmosphere through standard pressure-vacuum valves 19. In contrast, if the pressure in UST 5 is less than that of the ambient, a standard vent 17 allows fresh air into UST 5 to equalize the pressure. The fresh air becomes saturated with hydrocarbons and increases the pressure within the tank 5 and hydrocarbon laden vapor is then released to ambient through the vent 17. As the tank continues to "breathe" in this manner, hydrocarbons are repeatedly released to the atmosphere. Thus, it is important to minimize any pressure differential between UST 5 and the atmosphere to prevent the ingestion of air. By controlling in a coordinated fashion all of the vapor handling subsystems and related conditions in the fueling environment, the present invention is more capable of minimizing this pressure difference than typical fueling environments which have several subsystems operating independently of each other.

When fueling a standard or non-ORVR equipped vehicle, the vapor recovery system of fuel dispenser 18 should pull in enough hydrocarbon vapor and air mixture to compensate for the dispensed liquid fuel and minimize breathing losses. When an ORVR equipped vehicle is detected, the dispenser 18 compensates for the vapor recovered by the vehicle's ORVR system by pulling in ambient air.

Upon detection of an ORVR equipped vehicle, slowing down the vapor return pump 14 allows for continuous monitoring of the vapor concentration in the vapor return passage 8 to ensure that a mistake was not made in the initial identification of an onboard vapor recovery system associated with the vehicle. Alternatively, the vapor recovery pump 14 could simply shut down until the next transaction. Other approaches may forego shutting down the fuel dispenser's vapor recovery system. For example, the system may redirect the flow of air from the apertures 29 through vapor passage 8 to ambient through valve 15 (see FIG. 1A). This may be used when the vapor recovery system of the dispenser 18 uses a liquid driven vapor pump 14. Redirecting flow to ambient will prevent over pressurizing the UST and reduce breathing losses. Such redirection will be affected as necessitated by overall site conditions and requirements by the central control system 50 and any vapor handling systems in the dispensers 18 or underground storage tanks 5.

The various sensors, such as the hydrocarbon sensor 32 or the infrared detection sensor 36 provide a signal 54 to a dispenser processing unit (CPU) 56. The CPU 56 evaluates the signal 54 to determine whether the vehicle being fueled has an onboard vapor recovery system and passes such information on to the central control system 50. Accordingly, the CPU 56 provides a control signal 58 to a vapor recovery pump controller 60. The control signal 58 is preferably affected or influenced by overall site conditions and necessary control adjustments provided by the central control system 50. The vapor recovery pump controller 60 then controls the vapor recovery pump 14 with control signal 62.

Figure 9:
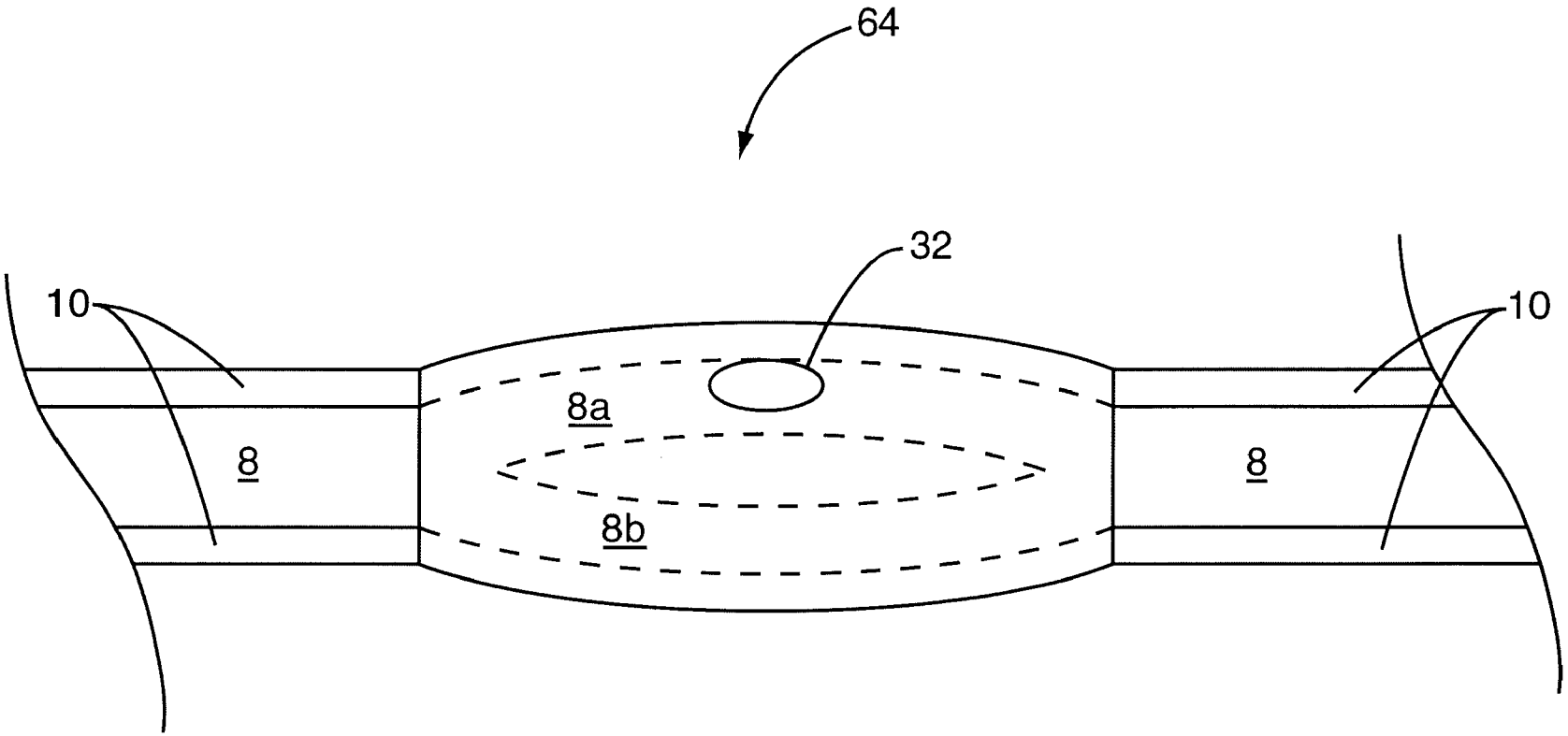
FIG. 9 is a perspective view of a module for diverting vapor flow for hydrocarbon sensing.

As shown in FIG. 9, any of the hydrocarbon sensors 32 may be installed within a separate module 64 designed to divert the flow path of a certain amount of fuel vapors. The module 64 may split the vapor path 8 into two vapor paths 8*a*, 8*b*. The hydrocarbon sensor is installed in one vapor path 8*b*. In the fiber-optic sensor embodiment, vapor path 8*b* of module 64 may be designed so that only a fraction of the hydrocarbon vapor and air mixture flows over the probe 44.

Once detection of a vehicle equipped with an onboard vapor recovery system occurs, various vapor recovery control options are available. Disabling the fuel dispenser's vapor recovery system reduces underground storage tank pressure and thereby reduces losses due to fugitive emissions and reduces wear and unnecessary use of assist type vapor recovery systems when operation would be redundant. Alternatively, the dispenser's vapor recovery system is adjusted to reduce the vacuum created by the fuel dispenser during the fueling of an onboard vapor recovery equipped vehicle. The vapor recovery system provides enough ambient air to the UST 5, that when the air saturates, the hydrocarbon saturated air volume is approximately equal to the amount of fuel dispensed; thereby minimizing pressure fluctuation in the USTs. Another option, particularly useful with liquid driven vapor pumps, is to use an output of CPU 56 to open valve 15 to redirect the airflow in the vapor recovery passage 8 to atmosphere through the vapor passage vent valve 15 (as shown in FIG. 3). All of these controls may be directly or indirectly controlled by the central control system 50.

Adjusting the vacuum created by the fuel dispenser's vapor recovery system prevents over pressurizing the underground fuel tanks 5, thus mitigating fugitive emissions. Fugitive emissions is a collective term for emissions from the vent 19 or any other leak path to the atmosphere at the dispensing facility.

The current invention may adjust any of the vapor handling systems in cooperation with the vent 17 to compensate for both vapor shrink and vapor growth conditions in the UST 5. Typically, during vapor shrink conditions, an amount of air greater than the volume of liquid dispensed is drawn into the tank 5. The current invention can reduce or increase the amount of vapor recovery drawn by the fuel dispenser's vapor recovery system to compensate for both vapor shrink or vapor growth conditions, but such will be subject to the minimal V/L ratio necessary to capture the required amount of vapor at the vehicle fill neck 22. Specifically, current regulations require 95% efficiency at the vehicle fill neck 22. Vapor shrink conditions usually occur during hot summer months when the ambient temperature is high and the tank temperature is relatively cool. As the air and/or vapor is drawn into the tank, the air or vapor contracts. The fuel dispenser compensates for this decrease in volume by increasing the amount of air and/or vapor discharged into the UST 5.

In contrast with the vapor shrink conditions, vapor growth conditions typically occur during winter months when the ambient temperature is low and the tank temperature is relatively high. Under vapor growth conditions, the air pulled into UST 5 expands when subjected to the warmer tank temperatures. The fuel dispenser's vapor recovery system pulls in an amount of air less than the amount of fuel dispensed to compensate for the volume expansion in the tank. The CPU 56 of fuel dispenser 18 and/or central control system 50 may receive temperature data from an ambient temperature sensor 61 and an UST temperature sensor 68 (see FIG. 1). Pressure measurements at ambient and in the tank ullage may also be taken. Alternatively, rough air ingestion compensation may be accomplished by having select flow settings for various times of the day or year. For example, under conditions of vapor shrinkage at the vehicle, the recovery system can be set to ingest air or vapor mixture in an amount equal to two-thirds the volume of fuel dispensed, thus allowing the air or vapor mixture to expand by a factor of approximately 1.4 or 1.5 to fill the tank volume when saturated. Overall site management allows fine tuning of the system.

Also, the fuel dispenser's vapor recovery system may continually monitor the vapor concentration to ensure an initial mistake was not made in determining whether or not the vehicle being fueled has an ORVR system or if a malfunction in the vehicle's ORVR system occurs. In either of the latter two cases, the fuel dispenser's vapor recovery system resumes vapor recovery accordingly.

The disclosed and claimed invention also encompasses kits, modules and the like for retrofitting pre-existing dispensers to enable ORVR equipped vehicle detection. For retrofitting, sensor modules are configured to associate operatively with existing pump electronics (see FIG. 8). For example, the sensor and/or sensor module is placed along or within the vapor passage 8 to sense hydrocarbon levels. Preferably, the sensor or module is placed within the vapor passage 8 at points allowing the easiest and most economical access to the vapor path, such as at the inlet or outlet of the vapor pump 14, or other connection points in the system.

Figure 10:
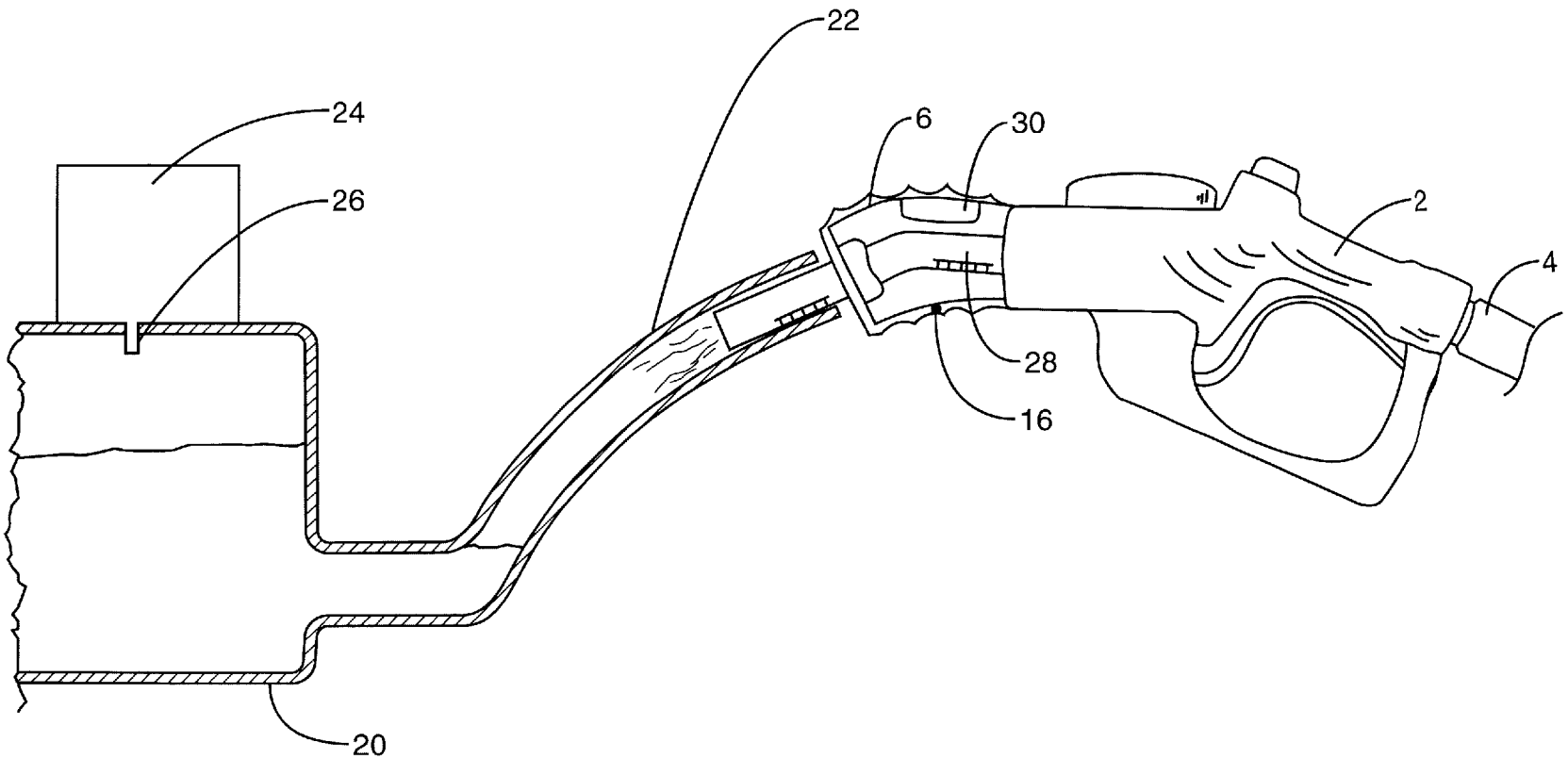
FIG. 10 is an elevational and partial sectional view of a booted fuel dispensing hose and nozzle inserted into a motor vehicle gasoline tank having an onboard vapor recovery system.

In an alternative embodiment for detecting ORVR equipped vehicles, pressure changes in the vapor recovery passageway may be used to detect such vehicles. As shown in FIG. 10, the nozzle 2 may include a vapor recovery boot 6 for preventing fuel vapors from escaping to atmosphere during the vapor recovery process. The vapor recovery boot 6 of nozzle 2 forms an annular chamber about nozzle 28 and covers the end of filler pipe 22. The annular chamber formed by vapor recovery boot 6 and the nozzle spout 28 operatively communicates with the vapor recovery passage 8. A pressure sensor 30 is placed in the annular chamber formed by the vapor recovery boot 6 and the nozzle spout 28 to detect an increase in vacuum associated with the vehicle's onboard vapor recovery system working in opposition to the fuel dispenser's vapor recovery system. In this embodiment, the increased vacuum may trip the nozzle's automatic shutoff venturi mechanism (not shown) and therefore make fueling extremely difficult if not impossible. Therefore, it is preferable that there be no "airtight" seal between the vapor recovery boot 6 and the fill neck 22 and that the vapor recovery system is vented via valve 15 to allow normal fueling.

Additionally, equipping the vapor recovery boot 6 with an orifice 16 designed to allow a vacuum in excess of 20–25 inches to be developed in the fill pipe area when fueling a vehicle equipped with an onboard vapor recovery system will eliminate premature cut-off. This level of vacuum is high enough to be recognized by the fueling system, but not enough to trip the automatic shutoff mechanism of the nozzle 2. The increase in the vacuum may be detected by placing the sensor 30 in the boot area as shown, at the vapor recovery pump 14, or anywhere along the vapor recovery passage 8.

A vehicle discrimination system using a transponder 164 or other like communication system may be configured to transit a signal indicative of the absence or presence of an ORVR system. When a dispenser 18 receives a signal via interrogator 152 indicating the absence or presence of an ORVR system, the vapor recovery system of the dispenser 18 may be shut-off or modified as desired during the subsequent fueling operation. A simplistic approach incorporates a signal from the transponder 164 to the dispenser 18 to indicate the presence of an ORVR system. Upon receipt of this signal, the dispenser 18 may deactivate the vapor recovery system during the fueling operation. A more complex system may incorporate a two-way communication link between the transponder 164 and the dispenser 18 wherein information in addition to that regarding the presence of an ORVR system is included to enable the dispenser to control the vapor recovery system in conjunction with the vehicle's ORVR system to maximize vapor recovery and fuel flow rate and/or according to a vapor recovery control function for the particular vehicle. The central control system 50 will preferably influence the dispenser's vapor recovery control in an effort to increase overall site efficiency.

Figure 10A:
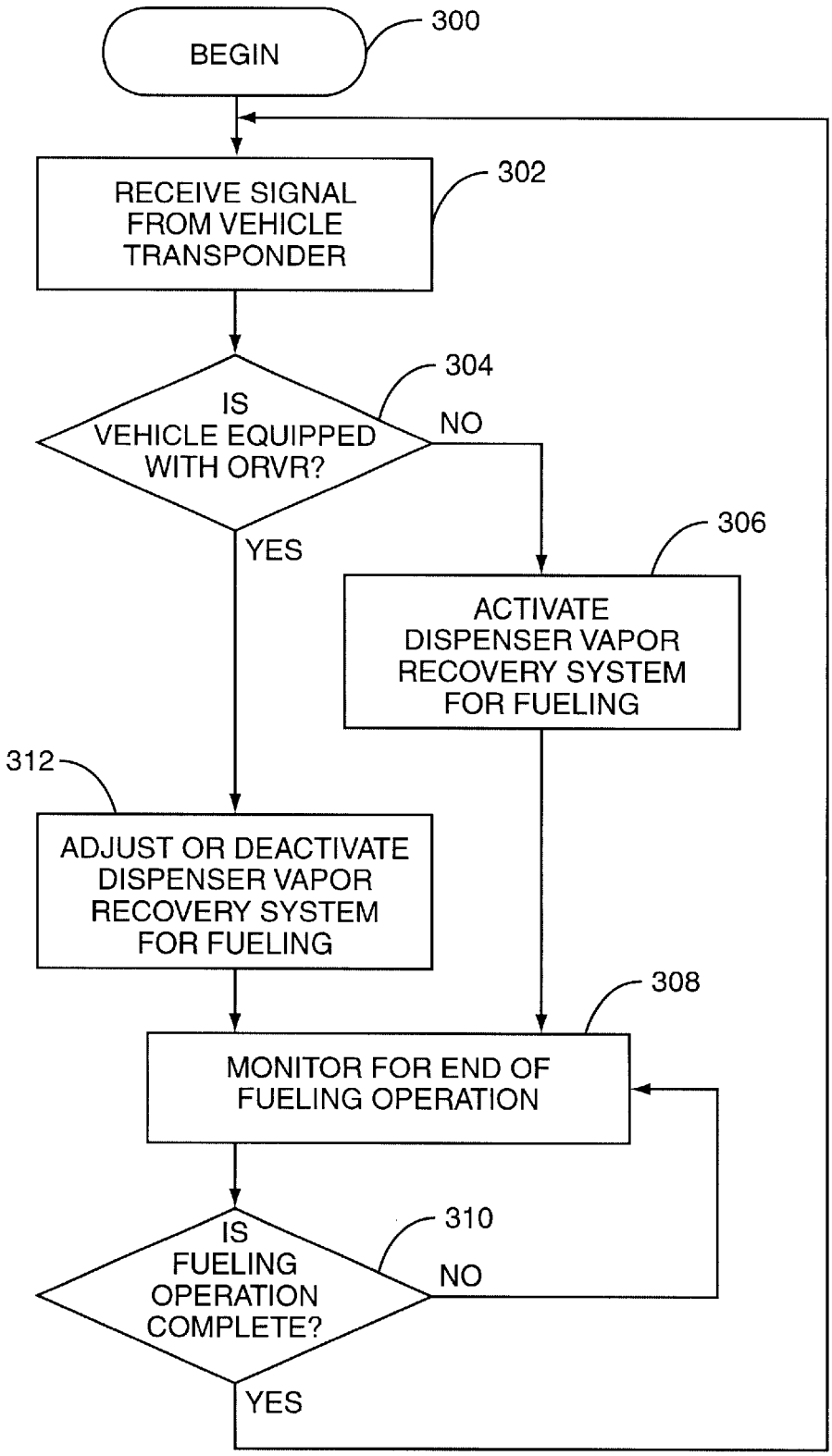
FIG. 10A is a flow chart representing a basic flow of a control process for controlling a vapor recovery system according to the present invention.

A basic flow chart of these processes is shown in FIG. 10A. The process starts (block 300) wherein the control system 50 begins to monitor and receive signals from the vehicle's transponder 164 (block 302). The control system 50 will determine whether the vehicle is equipped with an ORVR system (decision block 304). If the vehicle is not equipped with an ORVR system, the control system 50 will activate the dispensers' vapor recovery system for the subsequent fueling operation (block 306). The control system 50 will monitor for the end of the fueling operation (block 308) and determine the end of the fueling operation (block 310). Once the fueling operation is complete, the process is ready to be repeated. If the transponder 164 represents to the control system that the vehicle 100 is equipped with an ORVR system (decision block 304), the vehicle's vapor recovery system may be adjusted or deactivated completely during the subsequent fueling operation based on local and overall site parameters (block 312).

Figure 10B:
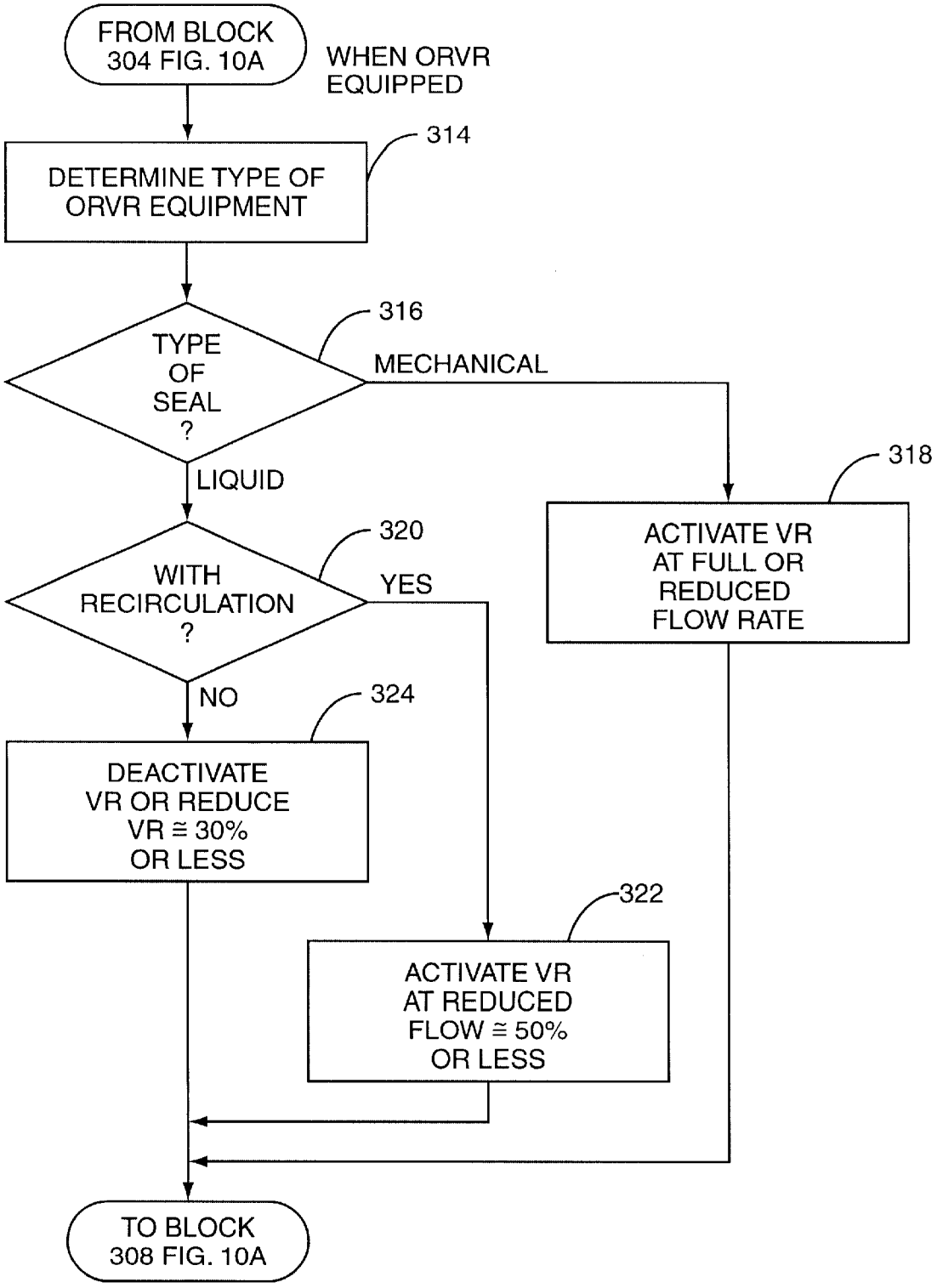
FIG. 10B is a flow chart representing a detailed flow of a process controlling a vapor recovery system depending on the type of ORVR equipment present on the vehicle.

As noted, when ORVR equipment is detected on the vehicle 100, the vapor recovery control system 50 may adjust or deactivate the vapor recovery system in various ways. Preferably, the control system 50 is adapted to receive the type of ORVR equipment and control the vapor recovery system of the fuel dispenser accordingly. An exemplary process of the preferred embodiment is shown in FIG. 10B. The scenario depicted in FIG. 10B represents a preferred scenario and is not intended to limit the concept of controlling the vapor recovery system based on the type of ORVR equipment on the vehicle. With this in mind, the process is picked up after ORVR equipment is detected (block 304 of FIG. 10A).

Once ORVR equipment is detected, the control system 50 determines the type of ORVR equipment present on the vehicle (block 314). The control system 50 will determine whether the ORVR equipment uses a mechanical or liquid seal (block 316). If a mechanical seal is used, the control system will preferably activate the vapor recovery system at a full or reduced flow rate to compensate for the volume of fuel leaving the underground storage tank 5 (block 318). If a liquid seal is used, then preferably the flow rate is designed to run at a reduced flow rate to facilitate ingestion of hydrocarbon vapors escaping the vehicle's ORVR equipment while minimizing the amount of hydrocarbon-free air ingested in the tank. As discussed in detail below, ingesting unsaturated, hydrocarbon-free air into the UST 5 is preferably avoided to the extent possible.

If a liquid seal is detected, the control system 50 will determine whether or not the vehicle's tank and ORVR system provides recirculation with the liquid seal embodiment (block 320). If recirculation is provided, the control system 50 will completely deactivate the vapor recovery system or activate the vapor recovery system of the fuel dispenser 18 at a significantly reduced flow rate of generally about fifty percent (50%) or less (block 322), depending upon conditions. In liquid seal arrangements using recirculation, there tends to be a higher vapor concentration at or near the nozzle spout 28 in the fill neck 22 of the fuel tank 20 than in liquid seal systems without recirculation. Control system 50 will preferably run the vapor recovery equipment of the dispenser 18 at a recovery rate sufficient to replace the volume lost in UST 5 and, with enough unsaturated hydrocarbon/air vapor mixture that, when saturated, equals the volume of fuel removed from Ust 5, the escape of any hydrocarbon-saturated air at or near the nozzle spout 28.

When a liquid seal embodiment without recirculation is detected, the control system will completely deactivate the vapor recovery system or may substantially reduce the rate of flow in the vapor recovery system to typically ten to thirty percent (10%–30%) of the nominal flow rate used during a normal vapor recovery operation (block 324). Running the dispenser's vapor recovery system for both liquid seal types without these controls would result in ingesting excess hydrocarbon-free air—a situation preferably avoided.

Importantly, the control system 50 is adapted to operate in conjunction with the communications electronics of the dispenser 18 to determine the type of ORVR equipment and control the vapor recovery system to optimize vapor recovery and reduce the amount of unsaturated or hydrocarbon-free air ingested into the UST 5. After the type of ORVR equipment is detected and the control is determined, the process will continue as shown in FIG. 10A (block 308) by monitoring for the end of the fueling operation. Currently, there are no ORVR recovery requirements when fueling at a rate under 4–6 gpm. At fuel delivery rates less than 4–6 gpm, the dispenser 18 may operate the vapor recovery system at normal or modified rates in order to achieve CARB mandated overall recovery rates during a portion of or the entire fueling operation.

Figure 10C:
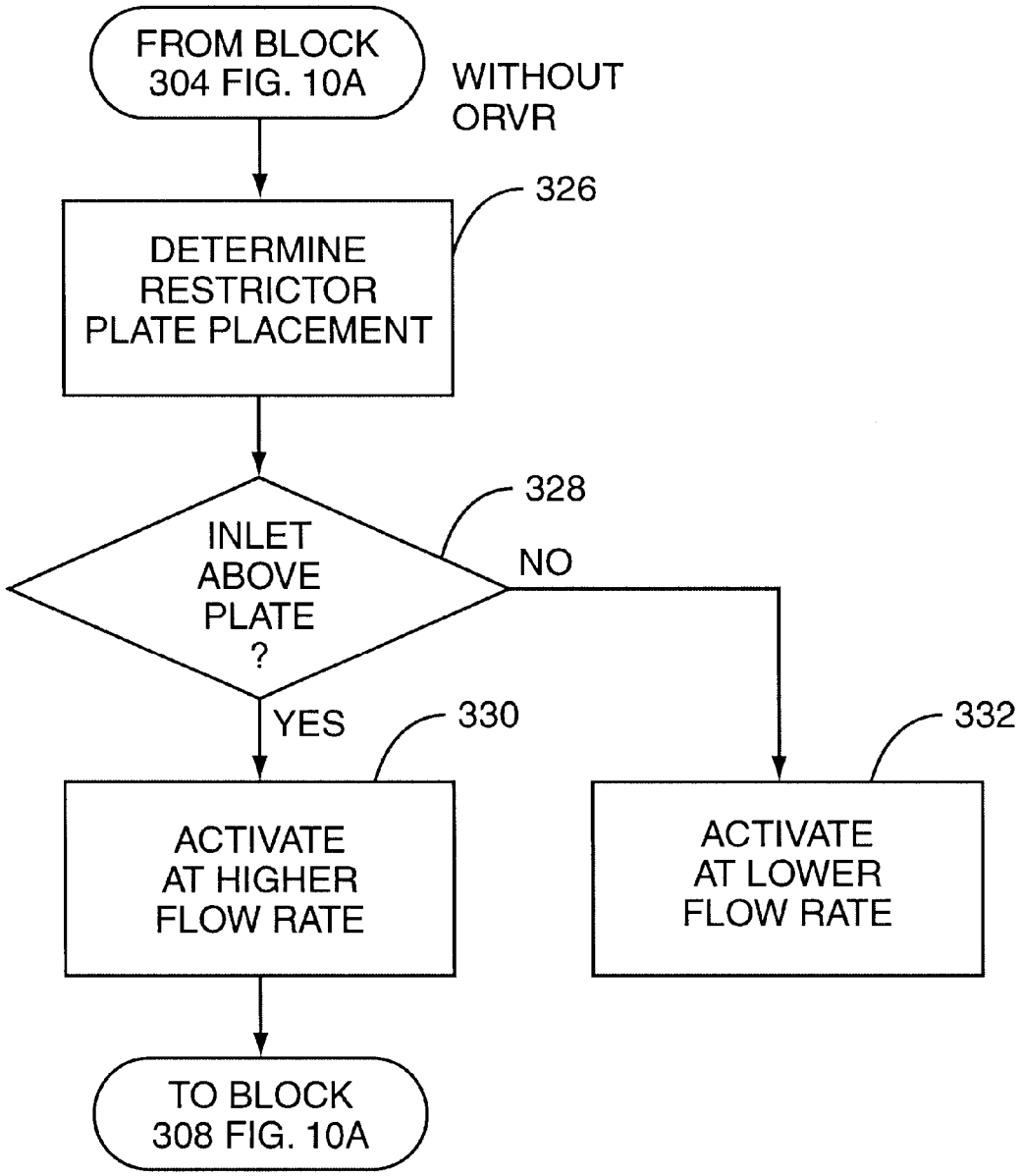
FIG. 10C is a flow chart representing a basic flow of a control process controlling a vapor recovery system according to the placement of a restrictor plate in the fuel neck of a vehicles fuel tank according to the present invention.

FIG. 10C depicts more detail of the exemplary process shown in FIG. 10A when ORVR equipment is not present on the vehicle being fueled. The detail relates to the vapor recovery control of the fuel dispenser's vapor recovery system when the placement of a restrictor plate 31 in the fill neck 22 of a fuel tank 20 is known. As shown in FIG. 3, the nozzle spout 28 typically extends through a restrictor plate 31 in the fuel tank's fill neck 22. The nozzle 28 includes a plurality of apertures 29 communicating with the vapor return passage 8. The restrictor plate 31 substantially blocks the fuel tank's fill neck 22 and includes an opening sized to allow the nozzle spout 28 to extend through during fueling. The opening may have a door, which closes when the vehicle is not being fueled. Most non-ORVR fuel tanks have a vent tube 33 running from a top portion of the tank to a point near the end of the fill neck 22. Certain fuel tanks 20 have the vents extending past the restrictor plate 31, such that vapors vented from the top of the tank through the vent tube 33 are placed back into the fill neck 22 between the restrictor plate 31 and the outside of the vehicle, while other tanks balance vapors via the vent tube 33 back into the fill neck 22 between the fuel tank 20 and the restrictor plate 31 as shown in FIG. 3. In the former situation where the vent tube 33 is above the restrictor plate 31, it is more difficult to recover the fuel vapors because of the unconfined environment at the end of the fill neck 22. When the vent tube 33 connects to the fill neck 22 below the restrictor plate 31, the vapors are concentrated in the confined area just before the restrictor plate 31 near the end of the fill neck 22.

Thus, an embodiment of the present invention is adapted to determine the placement of the restrictor plate 31 relative to the vapor return inlet of the vent tube 33 and control vapor recovery accordingly. Again, the information will be provided by the transponder 164 of the vehicle 100 (block 326). If the inlet is above the restrictor plate 31 (block 328), the control system 50 will preferably operate the dispenser's vapor recovery system at a higher flow rate (block 330) given the increased difficulty in recovering vapors in the relatively uncontained area between the restrictor plate 31 and ambient near the very end of the fill neck 22. If the inlet is not above the restrictor plate 31, the control system 50 will operate the dispenser's vapor recovery system at a lower flow rate (block 332) because the fuel vapors will be highly concentrated and contained below the restrictor plate 31 near an upper portion of the fill neck 22. Once the vapor recovery control is set, the process will return to block 308 of FIG. 10A.

Figure 11:
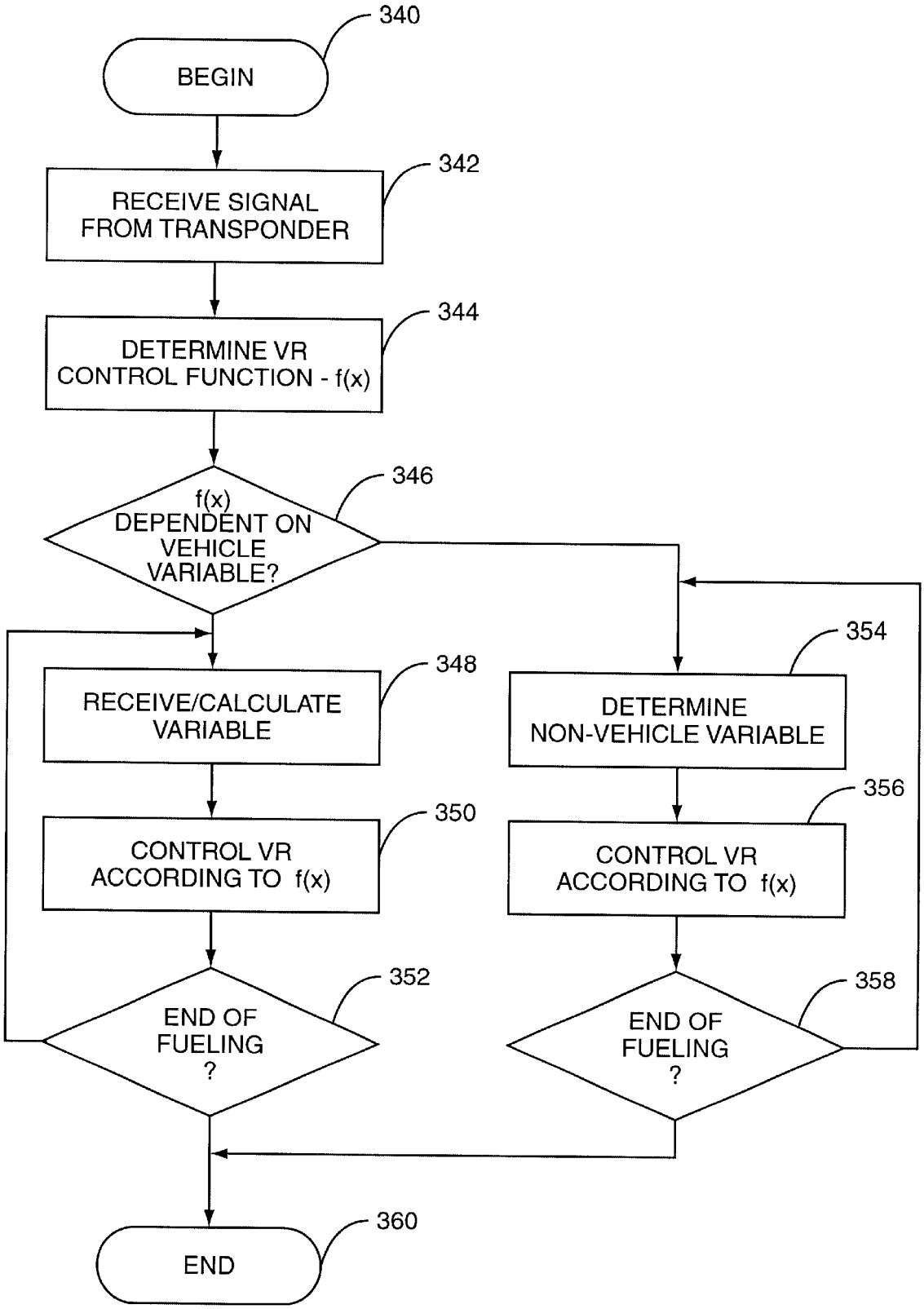
FIG. 11 is a flow chart representing a basic flow of a vapor recovery control process according to the present invention.

Another control option, used alone or in combination with the earlier described processes, provides a vapor recovery control function to optimize vapor recovery for a particular vehicle and/or fuel tank configuration with or without ORVR equipment. As shown in FIG. 11, the process begins (block 340) where signals are received from a transponder (block 342). From these signals, the control system 50 determines a vapor recovery control function (block 344). The control function may take many forms and be dependent upon a number of different variables. The variables may be vehicle specific, such as ullage values, fuel quantities, temperature, pressure, or any combination thereof, to name a few. The variables may also be non-vehicle specific, such as time, flow rate, vapor recovery flow rate or amount of fuel delivered. Additionally, the function may be a constant representing a fixed flow rate for a particular vehicle or tank configuration.

The control system 50 will determine whether or not the vapor recovery control function is dependent upon a vehicle-specific variable (block 346). If the function is dependent upon a vehicle-specific variable, the control system 50 will receive or calculate the variable and control function (block 348) and control the vapor recovery system accordingly (block 350). Control system 50 will then monitor for the end of fueling (block 352). If fueling is not at an end, the process may include a loop to repeat in which a new value is either received from the vehicle or calculated at the control system 50 to arrive at a flow rate according to the vapor recovery function. For example, if the function is based on ullage, the control system 50 may continuously monitor the new ullage values from the vehicle or calculate the new ullage values based on the original ullage value and the amount of fuel delivered, which is a value capable of being determined by the dispenser. At the end of fueling, the process ends (block 360).

If the vapor recovery control function is not dependent upon the vehicle variable (block 346), the appropriate variables are determined, if necessary, at the control system (block 354). The vapor recovery control function will be calculated based on the desired variables, and the vapor recovery system is controlled accordingly (block 356). The control system 50 will repeat the process until the end of fueling (blocks 358, 360). Notably, if the vapor recovery control function is a constant, the control system 50 need not update the control function throughout the fueling process.

However, certain embodiments may require combination of a constant vapor recovery flow rate for one portion of the fueling operation and a variable flow rate for another portion of the fueling operation.

Even when an ORVR equipped vehicle is detected, it may be desirable to have the dispenser's vapor recovery system operate to supply an amount of air to UST 5 required to replenish the volume of liquid taken from UST 5 during the fueling operation to minimize or eliminate UST 5 breathing loses discussed above. The transponder 164 of the vehicle 100 and dispenser may also communicate information relating to the effectiveness or the presence of a malfunction of the ORVR system. In such cases, the dispenser 18 may further modify or activate the vapor recovery system accordingly to minimize the escape of vapors during the fueling operation. Importantly, any of the above control functions may be altered, influenced, or otherwise affected by the central control system 50 in an effort to improve overall site efficiency and not merely an efficiency at a single dispenser 18.

In sum, once the absence or presence of an ORVR equipped vehicle is detected, various vapor recovery control options are available. Appropriate control of the fuel dispenser's and underground storage tank's vapor handling systems as well as the vent reduces underground fuel tank pressure and thereby reduces loses due to fugitive emissions and reduces wear and unnecessary use of assist-type vapor recovery systems when operation would be redundant. The vapor recovery system may provide enough ambient air to the UST, so that when the air saturates, the hydrocarbon saturated air volume is approximately equal to the amount of fuel dispensed, thereby minimizing pressure fluctuations in the USTs. Another option, particularly useful with liquid driven vapor pumps, is to use an output of the control system to open a dispenser valve or tank vent valve 19 is to ambient to redirect the air flow of the vapor recovery passage to atmosphere through an ambient vent.

Attention is drawn to application Ser. No. 08/966,237 entitled TRANSPONDER DISTINCTION IN A FUELING ENVIRONMENT filed Nov. 7, 1997, in the name of William S. Johnson, Jr. and application Ser. No. 08/759,733 filed Dec. 6, 1996, entitled INTELLIGENT FUELING in the name of H. Craig Hartsell, Jr. et al. The entire disclosures of these patent applications are hereby incorporated herein by reference.

Although the present invention has been described with preferred embodiments, it is to be understood that modifications and variations may be utilized without departing from the spirit and scope of this invention, as those skilled in the art will readily understand. It should be understood that all such modifications and improvements have been deleted herein for the sake of conciseness and readability but are properly within the scope of the following claims. Such modifications, improvements and variations are considered to be within the purview and scope of the appended claims and their equivalents.

We claim:

1. A service station vapor management system comprising:

a) a plurality of vapor handling subsystems;

b) a controller in electronic communication with the vapor handling subsystems for monitoring a V/L ratio at each of the plurality of vapor handling subsystems, determining an overall service station V/L ratio, and controlling subsystem operation to maintain the V/L ratio within predetermined limits; and c) a plurality of sensors in electronic communication with said controller such that the controller may adjust independent subsystem operation based, at least in part, on an output from a sensor of said plurality of sensors.

2. The vapor management system of claim 1 wherein said plurality of sensors comprises at least an ambient temperature sensor.

3. The vapor management system of claim 2 wherein said ambient temperature sensor is situated within an underground storage tank.

4. A service station vapor management system comprising:

a) a plurality of vapor handling subsystems;

b) a controller in electronic communication with the vapor handling subsystems for monitoring subsystem operation, determining an overall service station V/L ratio, and controlling subsystem operation to maintain the V/L ratio within predetermined limits; and c) a plurality of sensors, including an ambient temperature sensor, in electronic communication with said controller such that the controller may adjust independent subsystem operation based, at least in part, on an output from a sensor of said plurality of sensors, wherein said controller adjusts the V/L ratio depending on an output from said ambient temperature sensor and a calculated fill neck efficiency generated from said output.

5. The vapor management system of claim 1 wherein said plurality of sensors comprises at least an underground storage tank pressure sensor.

6. The vapor management system of claim 1 wherein said plurality of sensor further comprises at least an underground storage tank temperature sensor.

7. The vapor management system of claim 1 wherein a V/L ratio associated with an individual vapor handling subsystem remains above a predetermined threshold.

8. The vapor management system of claim 7 wherein said predetermined threshold is 95% transfer efficiency.

9. The vapor management system of claim 1 wherein said controller decreases a rate of vapor recovery during vapor shrinkage conditions.

10. The vapor management system of claim 1 wherein said controller maintains the vapor recovery rate above a minimum threshold.

11. The vapor management system of claim 1 wherein said controller increases a rate of vapor recovery during vapor growth conditions.

12. A method of controlling vapor management within a service station comprising:

a) measuring a V/L ratio at each of a plurality of independent vapor recovery subsystems;

b) adjusting the V/L ratio of each subsystem independently of one another based on an output from one of a plurality of sensors associated with the service station vapor recovery management system; and c) maintaining each V/L ratio above a predetermined threshold.

13. The method of claim 12 wherein adjusting the V/L ratio of each subsystem independently of one another based on an output from one of a plurality of sensors associated with the service station vapor recovery management system comprises measuring an ambient temperature with one of said sensors.

14. The method according to claim 12 wherein adjusting the V/L ratio of each subsystem independently of one another based on an output from one of a plurality of sensors associated with the service station vapor recovery management system comprises measuring an underground storage tank temperature with one of said sensors.

15. The method according to claim 12 wherein adjusting the V/L ratio of each subsystem independently of one another based on an output from one of a plurality of sensors associated with the service station vapor recovery management system comprises measuring a pressure within an underground storage tank with one of said sensors.

16. The method according to claim 12 further comprising maintaining an overall V/L ratio above a certain predetermined threshold.

17. The method according to claim 12 further comprising limiting fugitive emissions by reducing vapor recovery during times when vapor pressure within the underground storage tank exceed a predetermined threshold as determined by one of said sensors.

18. The method according to claim 12 further comprising limiting the vapor recovery during times when the ambient temperature indicates that the vapor recovery would cause pressure within an underground storage tank to exceed a predetermined threshold as measured by different ones of said plurality sensors.

19. The method according to claim 12 wherein adjusting the V/L ratio of each subsystem comprises decreasing a rate of vapor recovery during vapor shrinkage conditions.

20. The method according to claim 12 wherein adjusting the V/L ratio of each subsystem comprises increasing a rate of vapor recovery during vapor growth conditions.

21. The method according to claim 12 wherein adjusting the V/L ratio of each subsystem independently of one another based on an output from one of a plurality of sensors associated with the service station vapor recovery management system comprises measuring a temperature within an underground storage tank.

22. A system for controlling vapor management within a service station comprising:

a) means for measuring a V/L ratio at each of a plurality of independent vapor recovery subsystems;

b) means for adjusting the V/L ratio of each subsystem independently of one another based on an output from one of a plurality of sensors associated with the service station vapor recovery management system; and c) means for maintaining each V/L ratio above a predetermined threshold.

23. The system of claim 22 wherein said means for adjusting the V/L ratio of each subsystem independently of one another based on an output from one of a plurality of sensors associated with the service station vapor recovery management system comprises means for measuring an ambient temperature with one of said sensors.

24. The system according to claim 22 wherein said means for adjusting the V/L ratio of each subsystem independently of one another based on an output from one of a plurality of sensors associated with the service station vapor recovery management system comprises means for measuring an underground storage tank temperature with one of said sensors.

25. The system according to claim 22 wherein said means for adjusting the V/L ratio of each subsystem independently of one another based on an output from one of a plurality of sensors associated with the service station vapor recovery management system comprises means for measuring a pressure within an underground storage tank with one of said sensors.

26. The system according to claim 22 further comprising means for maintaining an overall V/L ratio above a certain predetermined threshold.

27. The system according to claim 22 further comprising means for limiting fugitive emissions by reducing vapor recovery during times when vapor pressure within the underground storage tank exceed a predetermined threshold as determined by one of said sensors.

28. The system according to claim 22 further comprising means for limiting the vapor recovery during times when the ambient temperature indicates that the vapor recovery would cause pressure within an underground storage tank to exceed a predetermined threshold as measured by different ones of said plurality sensors.

29. The system according to claim 22 wherein said means for adjusting the V/L ratio of each subsystem further comprises means for decreasing a rate of vapor recovery during vapor shrinkage conditions.

30. The system according to claim 22 wherein said means for adjusting the V/L ratio of each subsystem further comprises means for increasing a rate of vapor recovery during vapor growth conditions.

31. The system according to claim 22 wherein said means for adjusting the V/L ratio of each subsystem independently of one another based on an output from one of a plurality of sensors associated with the service station vapor recovery management system comprises means for measuring a temperature within an underground storage tank.

* * * * *